US010725419B2

(12) United States Patent
Ishida

(10) Patent No.: US 10,725,419 B2
(45) Date of Patent: Jul. 28, 2020

(54) IMAGE FORMING APPARATUS INCLUDING AN INTERNAL SPACE

(71) Applicant: Masahiro Ishida, Kanagawa (JP)

(72) Inventor: Masahiro Ishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/411,374

(22) Filed: May 14, 2019

(65) Prior Publication Data

US 2019/0361381 A1 Nov. 28, 2019

(30) Foreign Application Priority Data

May 28, 2018 (JP) ..... 2018-101212
Dec. 4, 2018 (JP) ..... 2018-227716
Mar. 27, 2019 (JP) ..... 2019-060230

(51) Int. Cl.
*G03G 15/00* (2006.01)
*G03G 21/16* (2006.01)

(52) U.S. Cl.
CPC ..... *G03G 15/6573* (2013.01); *G03G 15/5016* (2013.01); *G03G 15/6502* (2013.01); *G03G 21/1614* (2013.01); *G03G 2215/00016* (2013.01)

(58) Field of Classification Search
CPC ..... G03G 15/5016; G03G 15/6502; G03G 15/6573; G03G 21/16; G03G 21/1614; G03G 21/1619; G03G 2215/00016; G03G 2221/1675; G03G 2221/1678
See application file for complete search history.

(56) References Cited

U.S. PATENT DOCUMENTS 8,831,502 B2 * 9/2014 Kohara ..... G03G 15/5016 358/498
2009/0060612 A1 3/2009 Kohara et al.
2009/0074491 A1 3/2009 Morohoshi
2010/0182654 A1 * 7/2010 Kohara ..... G03G 15/5016 358/474
2018/0157202 A1 * 6/2018 Watanabe ..... G03G 15/6502
2018/0284672 A1 * 10/2018 Saeda ..... G03G 15/5016

FOREIGN PATENT DOCUMENTS

JP 2003-091718 3/2003
JP 2004-032280 1/2004
JP 2004-184799 7/2004
(Continued)

*Primary Examiner* — Sophia S Chen
(74) *Attorney, Agent, or Firm* — Harness, Dickey and Pierce, P.L.C.

(57) ABSTRACT

An image forming apparatus includes an exterior housing, an image forming unit disposed in the exterior housing, to form an image on a sheet, a sheet tray disposed below the image forming unit to be drawable in a front face of the exterior housing, an ejection unit disposed above the image forming unit to eject the sheet on which the image is formed by the image forming unit, a conveyance path disposed on the front face of the exterior housing to guide the sheet from the sheet tray to the ejection unit via the image forming apparatus, an openably closable cover disposed in the front face of the exterior housing to openably close the conveyance path, and an space disposed side by side with the image forming unit in a lateral direction in the exterior housing.

16 Claims, 20 Drawing Sheets

(56) References Cited

FOREIGN PATENT DOCUMENTS

| | | |
|---|---|---|
| JP | 2005-017323 | 1/2005 |
| JP | 2005-033739 | 2/2005 |
| JP | 2009-063625 | 3/2009 |
| JP | 2009-260904 | 11/2009 |
| JP | 2017-167276 | 9/2017 |
| JP | 2018-005198 | 1/2018 |

* cited by examiner

IMAGE FORMING APPARATUS INCLUDING AN INTERNAL SPACE

CROSS-REFERENCE TO RELATED APPLICATIONS

This patent application is based on and claims priority pursuant to 35 U.S.C. § 119(a) to Japanese Patent Application No. 2018-101212, filed on May 28, 2018, Japanese Patent Application No. 2018-227716, filed on Dec. 4, 2018, in the Japan Patent Office, and Japanese Patent Application No. 2019-060230, filed on Mar. 27, 2019, in the Japan Patent Office, the entire disclosure of each of which is hereby incorporated by reference herein.

BACKGROUND

Technical Field

The present disclosure relates to an image forming apparatus.

Related Art

An image forming apparatus includes a scanner, an automatic document feeder, and an ejection unit to eject a sheet on which an image is formed.

For example, an image forming unit is disposed side by side with a recording sheet supply unit. Further, an image scanner and an operation unit are provided on the supply unit of the recoding sheet. An ejection tray is provided above the image forming unit.

SUMMARY

In an aspect of this disclosure, an improved image forming apparatus includes an exterior housing, an image forming unit disposed in the exterior housing, to form an image on a sheet, a sheet tray disposed below the image forming unit to be drawable in a front face of the exterior housing, an ejection unit disposed above the image forming unit to eject the sheet on which the image is formed by the image forming unit, a conveyance path disposed on the front face of the exterior housing, to guide the sheet from the sheet tray to the ejection unit via the image forming apparatus, an openably closable cover disposed in the front face of the exterior housing to openably close the conveyance path, and a space disposed side by side with the image forming unit in a lateral direction in the exterior housing. At least one of a scanner to read the image on a document, a document feeder to read an image on a document while conveying the document, a loading unit to load the document or the sheet, and a storage including a shelf is provided in the space.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
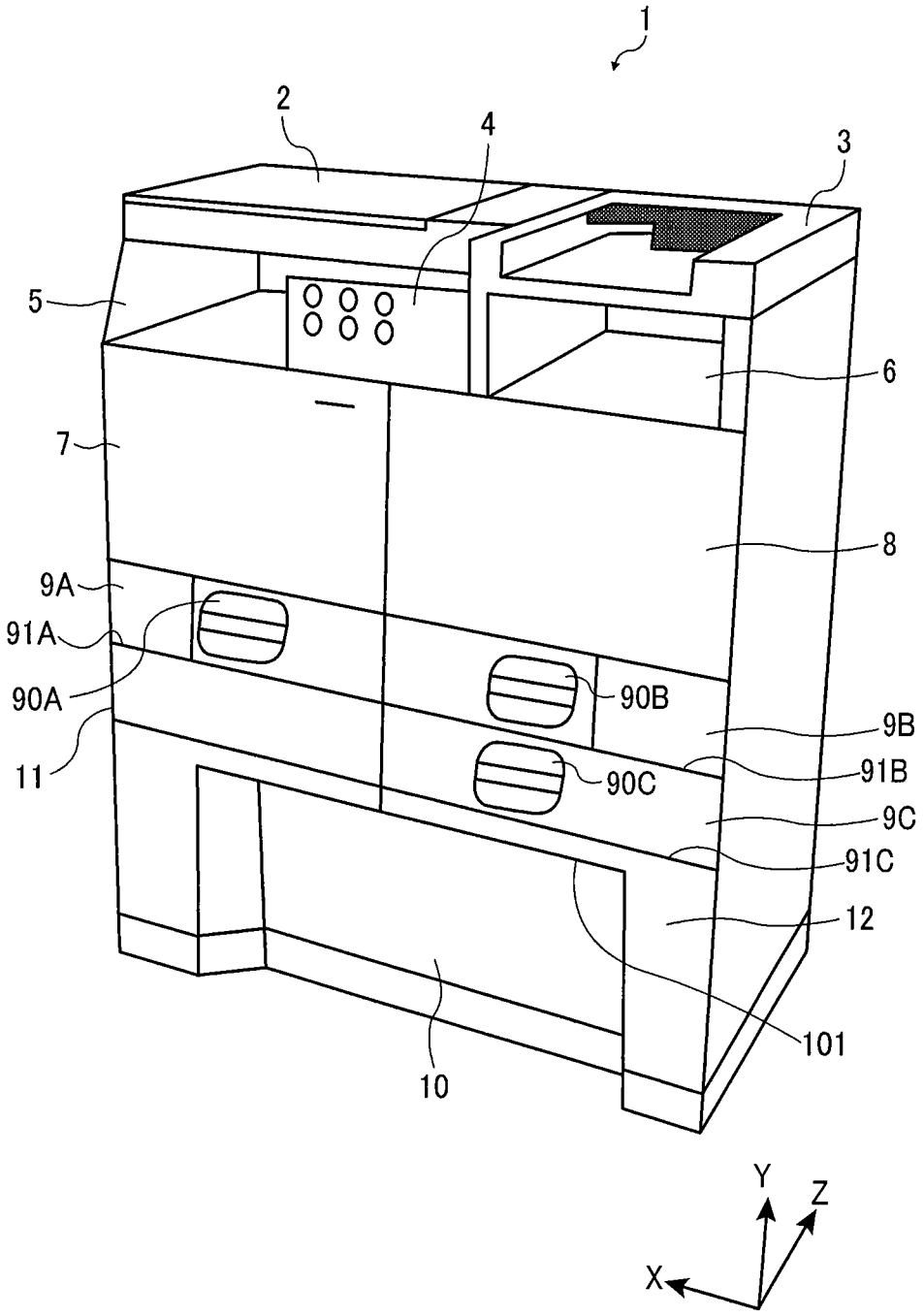
FIG. 1 is a schematic perspective view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms “a”, “an”, and “the” are intended to include the plural forms as well, unless the context clearly indicates otherwise.

Embodiments of the present disclosure are described below with reference to the attached drawings. Referring now to the drawings, wherein like reference numerals designate identical or corresponding parts throughout the several views thereof, an image forming apparatus according to an embodiment of the present disclosure is described.

FIG. 1 is a schematic perspective view of an image forming apparatus according to the present disclosure.

The image forming apparatus 1 includes a scanner 2 (an example of a scanner) that reads an image of a document, an automatic document feeder 3 that reads an image on a document while conveying the document, an operation unit 4 that receives an operation input to the image forming apparatus 1, an ejection unit 5 to eject and store the sheet on which an image is formed, a loading unit 6 to load a document or a sheet, an image forming unit 7 to form an image on a sheet, a jam processing unit 8 to process a sheet jammed at the image forming unit 7, sheet trays 9A, 9B, and 9C to stack sheets to be conveyed to the image forming unit 7, an opening 10 formed at a lower portion of the image forming apparatus 1, an electrical component housing 11 to house electrical components used in the image forming apparatus 1, and an exterior housing 12 to cover an internal configuration (main body) of the image forming apparatus 1.

In the following, a user operates a front side of the image forming apparatus 1 shown in each of the drawings. A surface of the image forming apparatus 1 where a user faces when a user operates the image forming apparatus 1 is referred to as the front face of the image forming apparatus 1. Also, as illustrated in FIG. 1, an X-axis direction indicates a lateral (width) direction of the image forming apparatus 1, a Y-axis direction indicates a height direction of the image forming apparatus 1, and a Z-axis direction indicates a depth direction of the image forming apparatus 1.

In FIG. 1, the upper portion of the ejection unit 5 is covered with a part of the image forming apparatus 1, for example, the scanner 2. Further, providing the ejection unit 5 within a dimension in the width direction (X-axis direction) of the image forming apparatus 1 can save space in the width direction (X-axis direction) of the image forming apparatus 1.

The operation unit 4 is preferably provided on the front side of the image forming apparatus 1 and near the center in the width direction (X-axis direction) so that a user can easily operate the operation unit 4. In FIG. 1, the operation unit 4 is disposed in the vicinity of an end portion of the ejection unit 5 near the center in the width direction (X-axis direction) of the image forming apparatus 1. That is, in FIG. 1, a back surface of the operation unit 4 opposite the front side of the image forming apparatus 1 faces the ejection unit 5. Note that the position of the operation unit 4 is not limited to the position illustrated in FIG. 1. Thus, the operation unit 4 may be disposed on a side surface of the scanner 2 or may be housed inside the image forming apparatus 1 when not in use.

The sheet trays 9A, 9B, and 9C includes handles 90A, 90B, and 90C, respectively, to pull out the sheet trays 9A, 9B, 9C from the image forming apparatus 1. A user pulls the handles 90A, 90B, and 90C toward the front side of the image forming apparatus 1 from a state in which the handles 90, 90B, and 90C are housed inside the image forming apparatus 1. Then, a user can select and withdraw at least a part of the sheet trays 9A, 9B, and 9C from inside of the image forming apparatus 1. The sheet trays 9A, 9B, and 9C may be referred to as a sheet tray 9 when it is not necessary to distinguish the sheet trays 9A, 9B, and 9C from each other.

The plurality of sheet trays 9A and 9B is arranged side by side in the width direction (X-axis direction) in the image forming apparatus 1 in FIG. 1. With such a configuration, it is possible to secure space for a plurality of sheet trays 9A, 9B, and 9C in the image forming apparatus 1 while improving operability of the sheet tray 9C disposed at the lowest side in the image forming apparatus 1.

When the plurality of sheet trays 9A, 9B, and 9C is arranged side by side in the lateral (width) direction (X-axis direction), the plurality of sheet trays 9A, 9B, and 9C may not have to overlap in the height direction (Y-axis direction) of the image forming apparatus 1 in FIG. 1. For example, the sheet tray 9A and 9C do not overlap in the height direction (Y-axis direction) of the image forming apparatus 1 and are arranged side by side in the lateral (width) direction (X-axis direction).

For example, it is said that a position of the sheet tray 9A to 9C at a height of about 300 mm or less from the floor is difficult to operate. However, if the image forming apparatus has a configuration in which the number of sheet trays 9 is increased in the height direction (Y-axis direction) of the image forming apparatus 1 to increase a paper feed capacity, the sheet tray 9 at the bottom of the image forming apparatus 1 may be disposed at low position such as about 100 mm from the floor.

If the sheet tray 9 is disposed at low position in the image forming apparatus 1, operability of the image forming apparatus may be degraded. For example, a user has to extend the hand to the low position of the sheet tray 9. Further, if a user is in a wheelchair, the wheelchair may hinder access to the seat tray 9, so that a user may not operate the sheet tray 9 disposed at the low position of the image forming apparatus 1.

Conversely, the image forming apparatus 1 in the present disclosure includes at least two sheet trays 9 arranged side by side in the lateral (width) direction (X-axis direction) of the image forming apparatus 1. Since the plurality of sheet trays 9 are accommodated within a narrow width (height) in the height direction (Y-axis direction), an operation range in the height direction (Y-axis direction) of the plurality of sheet trays 9 is narrowed.

Further, since the plurality of sheet trays 9 fits within a narrow width (height) in the height direction (Y-axis direction), the sheet tray 9 can be provided at a higher position from the floor by for an amount of the narrow width (height). Thus, a user does not have to reach the sheet tray 9 disposed at low position of the image forming apparatus 1. Further, a user in a wheelchair can easily access and operate the seat tray 9 because the wheelchair does not block access to the sheet tray 9.

The opening 10 has an opening upper end 101 that is an upper end of the opening 10. Further, in FIG. 1, the opening 10 is provided in front of the image forming apparatus 1 in the lower portion of the image forming apparatus 1. Therefore, a user in a wheelchair can approach the image forming apparatus 1 without hitting a footrest of the wheelchair at the bottom of the image forming apparatus 1.

Thus, a user in a wheelchair can operate each units of the image forming apparatus 1 such as the scanner 2, the automatic document feeder 3, the operation unit 4, the ejection unit 5, the loading unit 6, the image forming unit 7, the jam processing unit 8, the sheet tray 9, and the electrical component housing 11. The opening 10 is formed as a part of the exterior housing 12 as an example in FIG. 1. In other words, the opening upper end 101 functions as a part of the exterior housing 12.

Further, the opening 10 is opened in the front face of the image forming apparatus 1. Therefore, a user in a wheelchair can approach the image forming apparatus 1 while inserting the footrest of the wheelchair inside the opening 10 from the front face of the image forming apparatus 1. Thus, a user in a wheelchair can operate each units of the image forming apparatus 1 such as the scanner 2, the automatic document feeder 3, the operation unit 4, the ejection unit 5, the loading unit 6, the image forming unit 7, the jam processing unit 8, the sheet tray 9, and the electrical component housing 11. The operability of the image forming apparatus 1 thus can be improved.

Particularly, the footrest of the wheelchair protrudes forward than a position of a face or a body of a user sitting in a wheelchair. Thus, a user in a wheelchair has to place the wheelchair sideways to approach and operate the image forming apparatus 1. Thus, a sufficient space is required around the image forming apparatus 1 to enable a user in a wheelchair to approach and operate the image forming apparatus 1. The user in a wheelchair has to turn the wheelchair sideways against the image forming apparatus 1 to operate the image forming apparatus 1.

Figure 3:
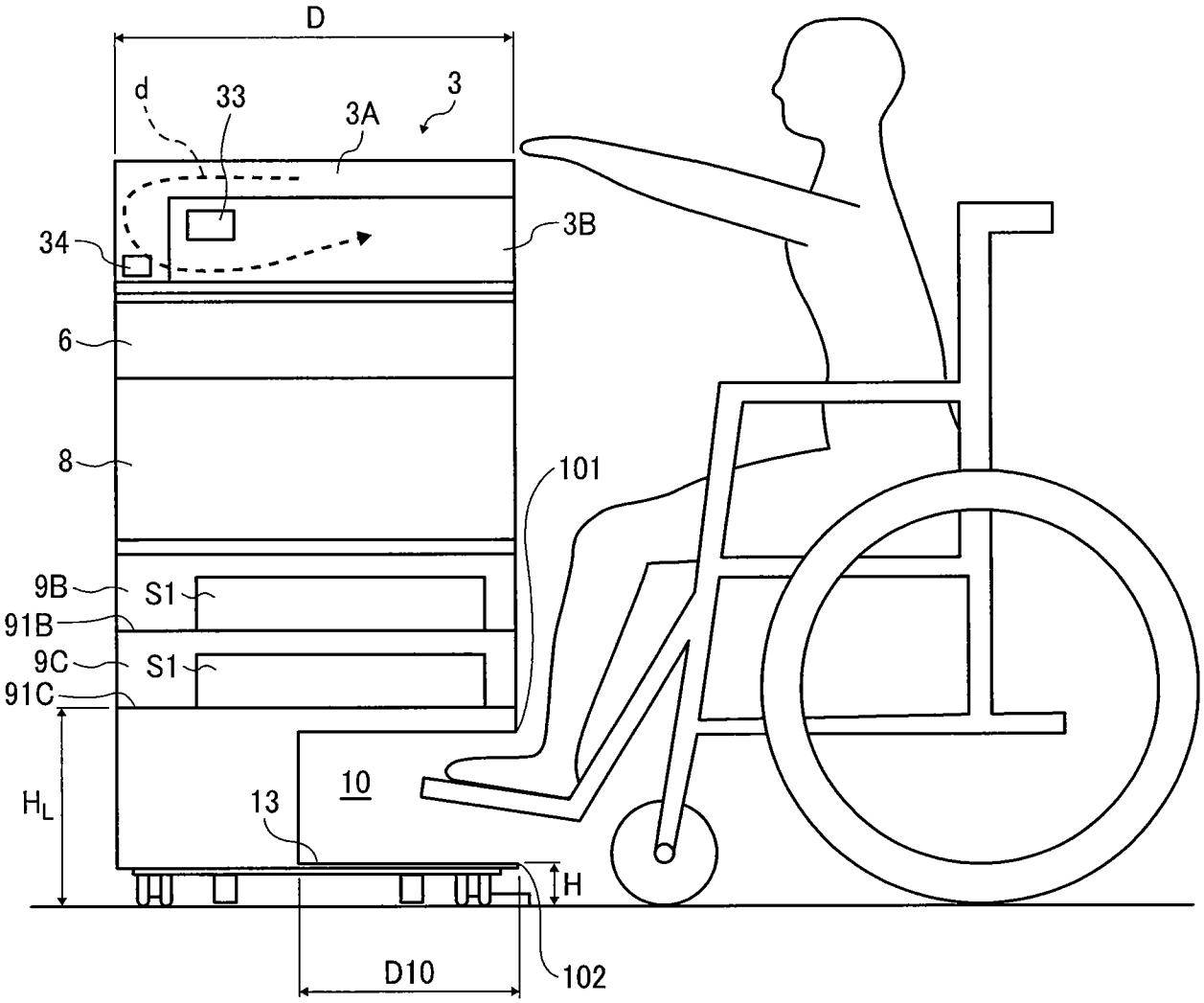
FIG. 3 is a cross-sectional view of the image forming apparatus according to the first embodiment.

Conversely, the image forming apparatus 1 according to the present disclosure includes the opening 10 in the lower portion of the front face of the image forming apparatus 1. Thus, as illustrated in FIG. 3, a user in a wheelchair can place the foot rest of the wheelchair in the opening 10 while the wheelchair facing the front face of the image forming apparatus 1 so that a user in a wheel chair can approach the image forming apparatus 1 by a distance enough to operate the image forming apparatus 1.

The electrical component housing 11 houses electrical components typified by a controller to control an image forming operation of the image forming apparatus 1, an electrical component board having a power source, and the like.

The exterior housing 12 has at least a front face, a side face, a back face that covers inside an interior of the image forming apparatus 1, and the depth and the width of the image forming apparatus 1 are determined by the depth (the distance between the front face and the back face) and the width (the distance between both side faces) in FIG. 1, for example.

The relative positions of the plurality of sheet trays 9A, 9B, and 9C and the opening 10 are described below. If bottom portions of the sheet trays 9A, 9B, and 9C are respectively referred to as bottom portions 91A, 91B, and 91C, the bottom portion 91C among the bottom portions 91A, 91B, and 91C is the lowest. The opening 10, more specifically, the opening upper end 101 is located below the bottom portion 91C of the sheet tray 9C that is the lowest sheet tray 9 among the bottom portions 91A, 91B, and 91C of the three sheet trays 9A, 9B, and 9C. More specifically, the opening 10 is located below the entire bottom portion 91C of the sheet tray 9C that is the sheet tray 9 having the lowest bottom portion 91C. The image forming apparatus 1 with such a configuration as illustrated in FIG. 1 enable the user to easily operate the image forming apparatus 1. For example, the operability of the lowest sheet tray 9C is improved.

The relative positions of the plurality of sheet trays 9A, 9B, and 9C are described below. The sheet tray 9C as the first sheet tray having the lowest bottom portion among the plurality of sheet trays 9 and the sheet tray 9A as the second sheet tray are arranged side by side in the lateral (width) direction (X-axis direction) of the image forming apparatus 1 in FIG. 1. With such a configuration, it is possible to secure space for a plurality of sheet trays 9A, 9B, and 9C in the image forming apparatus 1 while improving operability of the sheet tray 9C disposed at the lowest side in the image forming apparatus 1. When the plurality of sheet trays 9A, 9B, and 9C is arranged side by side in the lateral (width) direction (X-axis direction), the plurality of sheet trays 9A, 9B, and 9C may not have to overlap in the height direction (Y-axis direction) of the image forming apparatus 1 in FIG. 1. For example, the sheet tray 9A and 9C do not overlap in the height direction (Y-axis direction) of the image forming apparatus 1 and are arranged side by side in the lateral (width) direction (X-axis direction).

Next, the relative position of the plurality of sheet trays 9A, 9B, and 9C and the opening 10 are further described in detail below. The sheet tray 9C as the first sheet tray having the lowest bottom portion among the plurality of sheet trays 9 and the sheet tray 9A as the second sheet tray are arranged side by side in the lateral (width) direction (X-axis direction) of the image forming apparatus 1 in FIG. 1. Further, the opening 10 is located under at least one of the sheet tray 9C as the first sheet tray and the sheet tray 9A as the second sheet tray. Further, the opening 10 is located under the sheet tray 9A and 9C.

Further, the opening 10 is located under a portion between the sheet tray 9C and the sheet tray 9A. That is, the opening 10 is continuously formed from an area below the sheet tray 9C to an area below the sheet tray 9A. Thus, it can be said that the opening 10 extends from the area below the sheet tray 9A to the area below the sheet tray 9C. The opening 10 with such a configuration enables a user in a wheelchair to place the footrest of the wheelchair in the opening 10 so that the user in a wheelchair can easily reach and operate both the first sheet tray (sheet tray 9C) and the second sheet tray (sheet tray 9A).

A configuration of the front face of the image forming apparatus 1 is described below. In FIG. 1, the front face of each sheet trays 9 in a state in which the sheet trays 9A, 9B, and 9C are accommodated inside the image forming apparatus 1 and the front face of the exterior housing 12 are substantially in the same plane, for example. In other words, a portion of a surface forming the opening 10 of the exterior housing 12 and the front face of each of the sheet trays 9A, 9B, and 9C accommodated inside the image forming apparatus 1 are substantially in the same plane. Further, as one example, at least one end in the width direction of the sheet tray 9C is provided close to the right-side surface of the exterior housing 12 forming the opening 10. Thus, the one end of the sheet tray 9 disposed close to the exterior housing 12 is substantially in the same plane with the side face of the exterior housing 12 in a state in which the sheet tray 9 is accommodated inside the image forming apparatus 1.

The sheet tray 9C as the first sheet tray is the lowest sheet tray 9 among a plurality of sheet trays 9. The sheet tray 9A as the second sheet tray is arranged side by side with the sheet tray 9C. A maximum storage size of the sheets that can be stored in the sheet tray 9 (maximum number of sheets that can be stored in the sheet tray 9) may be different between the sheet trays 9A and 9C. Further, the maximum number of sheets that can be stored in each of the sheet trays 9 may be different from each other. The sheet trays 9 may have different maximum storage sizes. That is, the sheet trays 9 may have different widths in the width direction (X-axis direction) in the image forming apparatus 1. Further, the sheet trays 9 may have different maximum storage sizes, that is, different widths (heights) in the height direction (Y-axis direction) in the image forming apparatus 1. The sheet trays 9 having different maximum storage sizes are appropriately arranged in relation to other members. Thus, a degree of freedom of layout of the image forming apparatus 1 increases. For example, a maximum size and a maximum accommodation number of each sheet trays 9 is Legal: 500 sheets for the sheet tray 9A, A4: 100 sheets for the sheet tray 9B, and A4: 250 sheets for the sheet tray 9C.

Figure 2A:
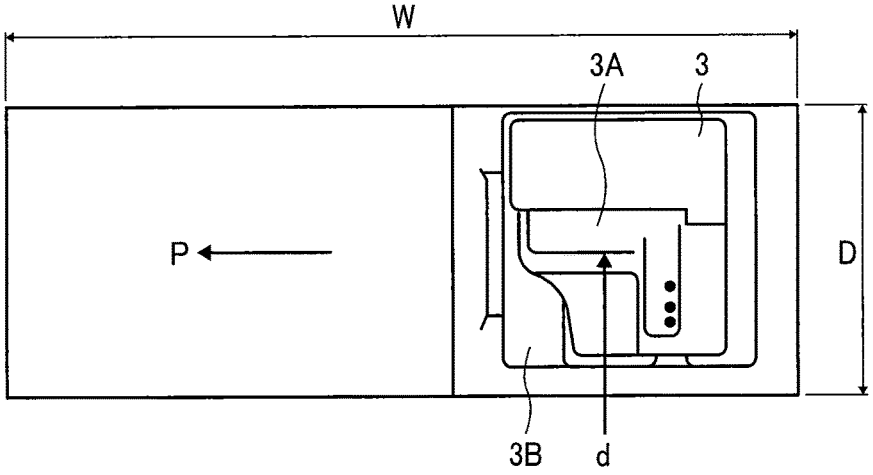
FIGS. 2A and 2B are a top view and a front view, respectively, of the image forming apparatus according to the first embodiment.
Figure 2B:
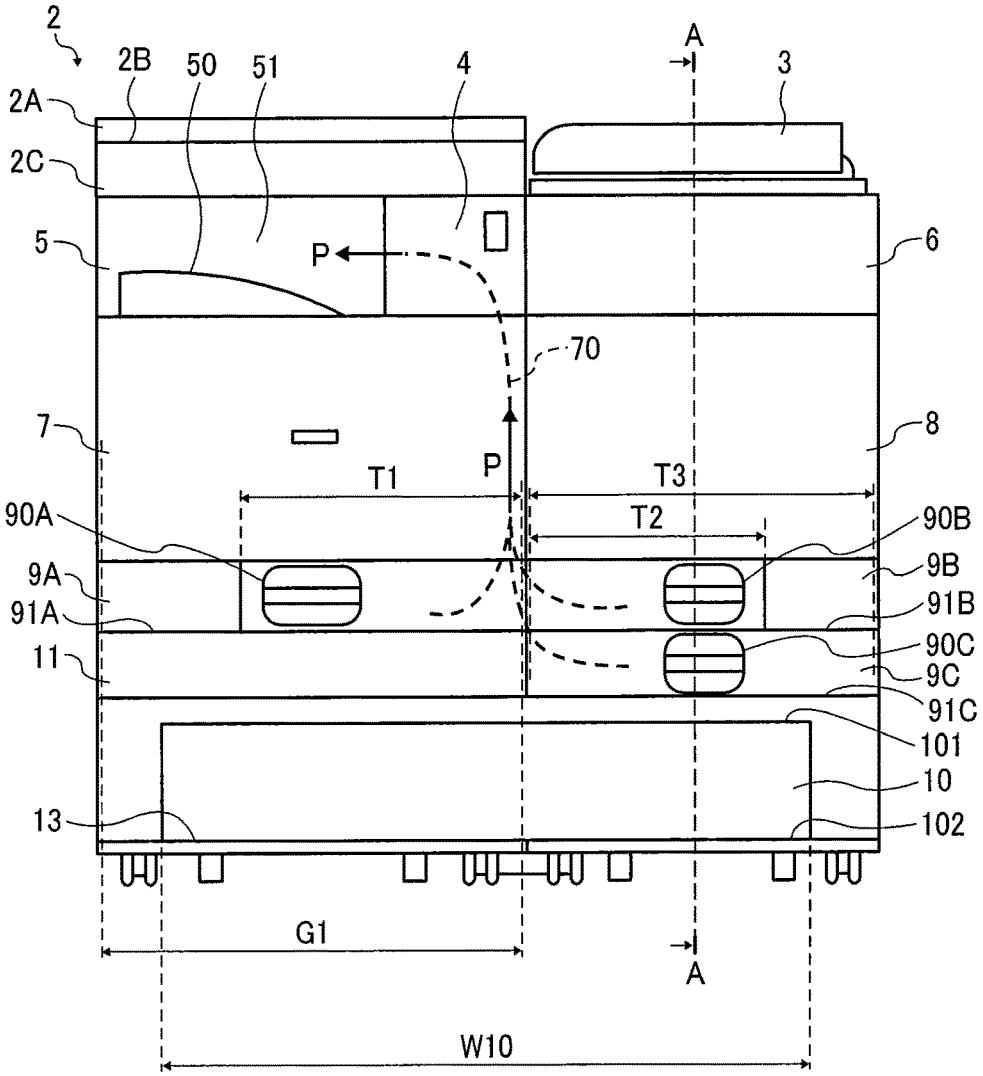

FIGS. 2A and 2B are top view and a front view, respectively, of an image forming apparatus 1 according to an embodiment of the present disclosure.

FIG. 2A is a top view of the image forming apparatus 1. In FIG. 2A, "W" represents a size in the width direction (X-axis direction) of the image forming apparatus 1, and is, for example, a distance between both side surfaces of the exterior housing 12. "D" represents a size in the depth direction (Z-axis direction) of the image forming apparatus 1, and is, for example, a distance between the front face and the back face of the exterior housing 12. The automatic document feeder 3 includes a document stacker 3A on which documents are stacked and a document ejection unit 3B on which the conveyed document is ejected.

Arrow "P" indicates a direction of conveyance of the sheet on which the image is to be formed and an ejection direction of the sheet on which the image has been formed. Arrow "d" indicates a direction of conveyance of the document in the automatic document feeder 3. The direction of conveyance of the arrow "P" and the direction of conveyance of the arrow "d" are orthogonal to each other. That is, the direction of conveyance of the document conveyed by the automatic document feeder 3 is orthogonal to the direction of conveyance of the sheet on which the image is to be formed. With such a configuration, it is possible to reduce the width of the image forming apparatus 1 when, for example, a long sheet is copied.

The width "W" of the image forming apparatus 1 is 900 mm or less, for example. A width of the image forming apparatus 1 is determined based on the size of typical office furniture, for example, a cabinet for storing documents. Thus, the image forming apparatus 1 does not protrude into an original path when the image forming apparatus 1 is installed in the office. Thus, it is easy for a user in a wheelchair to secure a passage around the image forming apparatus 1.

D is, for example, 450 mm or less. The width "W" of the image forming apparatus 1 is 900 mm or less, for example. A width of the image forming apparatus 1 is determined based on the size of typical office furniture, for example, a cabinet for storing documents. Thus, the image forming apparatus 1 does not protrude into an original path when the image forming apparatus 1 is installed in the office. Thus, it is easy for a user in a wheelchair to secure a passage around the image forming apparatus 1.

FIG. 2B is a front view of the image forming apparatus 1. In FIG. 2B, "G1" is a size (length) in the width direction (X-axis direction) of the image forming unit 7, "W10" is a size in the width direction (X-axis direction) of the opening 10, "T1" is a storage size of the sheet in the width direction (X-axis direction) of the sheet tray 9A, "T2" represents a storage size of the sheet in the width direction (X-axis direction) of the sheet tray 9B, and "T3" represents a storage size of the sheet in the width direction (X-axis direction) of the sheet tray 9C. Arrow "P" represents the direction of conveyance and the ejection direction of the sheet. The image forming apparatus 1 includes a bottom plate 13 at a bottom of the image forming apparatus 1. The bottom plate 13 is configured as a bottom portion of the opening 10. A front end the bottom plate 13 on the front face of the image forming apparatus 1 forms a lower end 102 of the opening 10. Further, the image forming apparatus 1 includes a conveyance path 70 as a sheet conveyor that conveys the sheets stored in the sheet trays 9A, 9B, and 9C to the image forming unit 7 and the ejection unit 5. The sheets stored in the sheet trays 9A, 9B, and 9C are conveyed along the conveyance path 70, and an image is formed on the sheets when the sheets are passed over the image forming unit 7 from below.

Thus, the image forming apparatus 1 includes an exterior housing 12, an image forming unit 7 in the exterior housing 12, the image forming unit 7, to form an image on a sheet S1, a scanner (the automatic document feeder 3) to read the image on a document, a first region (left side region in FIG. 2B) in a front face of the exterior housing 12, the image forming unit 7 being disposed in the first region, a second region (right side region in FIG. 2B) arranged side by side with the first region in a lateral (width) direction (X-axis direction) in the front face of the exterior housing 12, the scanner (the automatic document feeder 3) being disposed in the second region, and an opening 10 defining a space in the front face of the exterior housing 12. The opening 10 extends across the first region and the second region in a lower part of the exterior housing 12 below the image forming unit 7 and the scanner (the automatic document feeder 3).

As illustrated in FIG. 2B, a main body of the image forming apparatus 1 (interior configuration of the image forming apparatus 1 in FIG. 2B) includes the first region (left side region) and second region (right side region in FIG. 2B) arranged side by side with the first region in the lateral (width) direction (X-axis direction) of the exterior housing 12 in view from front side of the image forming apparatus 1 (view from Z-axis direction in FIG. 1).

The scanner 2, the ejection unit 5, image forming unit 7, the sheet tray 9A, and the electrical component housing 11 are provided in the first region. The automatic document feeder 3, the loading unit 6, the jam processing unit 8, and the sheet trays 9B and 9C are provided in the second region. The automatic document feeder 3 is an example of the scanner to read the image on the document. The jam processing unit 8 is an example of a space (enclosure) provided inside the exterior housing 12.

Here, the image forming unit 7 in the first region and the jam processing unit 8 in the second region overlaps in the height direction (Y-axis direction in FIG. 1) of the image forming apparatus 1 and are arranged side by side in the lateral (width) direction (X-axis direction). Thus, a part of the first region and a part of the second region overlap in the height direction.

Further, the user in a wheelchair can rotate the wheelchair or move the wheelchair in the width direction (X-axis direction) of the image forming apparatus 1 while inserting a part of the wheelchair, for example, the footrest inside the opening 10.

For example, if the width of the opening 10 is about the same as the width of the image forming unit 7, the user in a wheelchair has to move the footrest of the wheelchair out of the opening 10 every time to manipulate a member located beside the image forming unit 7 or to see a slightly different direction while operating the image forming unit 7. According to the configuration of the present disclosure, the user can perform various operations while stay close to the image forming apparatus 1.

The scanner 2 includes a pressure plate 2A to press the document, a reading unit 2B on which the document to be read is placed, and a scanner body 2C to read the image on the document stacked on the reading unit 2B. The ejection unit 5 has a sheet stacker 50 on which sheets on which images are formed are stacked and a take-out port 51 from which a user takes out the sheets on which images are formed. The take-out port 51 opens on the front face of the image forming apparatus 1. Thus, a user in a wheelchair can insert the footrest of the wheelchair in the opening 10 and moves closer to the image forming apparatus 1 so that a user in a wheelchair can take out the sheets on which the image is formed from the take-out port 51.

The pressure plate 2A is openably closable to the reading unit 2B. That is, the pressure plate 2A is movable between a closed position to cover and close an upper portion of the reading unit 2B and an opened position to open the upper portion of the reading unit 2B. FIG. 2B illustrates a state in which the pressure plate 2A is in the closed position. The document is placed on the reading unit 2B while the pressure plate 2A is moved to the opened position.

Then, the pressure plate 2A is moved to the closed position so that the scanner body 2C can read the document. The pressure plate 2A can prevent the document from being displaced by applying pressure to the document at the closed position. Further, the pressure plate 2A becomes a background plate at time of reading the document at the closed position so that the image forming apparatus 1 can perform good reading.

The automatic document feeder 3 can be openably closable to the loading unit 6. That is, the automatic document feeder 3 is movable between a closed position to cover and close an upper part of the loading unit 6 and an opened position to open the upper part of the loading unit 6. FIG. 2B illustrate a state in which the automatic document feeder 3 is in the closed position. Thus, the user places or takes out the document or the sheets on the loading unit 6 in a state in which the automatic document feeder 3 is moved to the opened position. Further, the user uses the automatic document feeder 3 in a state in which the automatic document feeder 3 is moved to the closed position.

A width "W10" of the opening 10 is, for example, 600 mm or more. The width "W10" of the opening 10 is equal to or greater than the width W1 of the wheelchair specified in Japanese Industrial Standard JIS_T9201. With such a configuration, the footrest of the wheelchair can be inserted into the opening 10. Thus, a user in a wheelchair can easily approach and operate the image forming apparatus 1.

The image forming apparatus 1 includes the jam processing unit 8 on a right side of the image forming unit 7 as a member arranged next to the image forming unit 7. Further, the width W10 of the opening 10 is wider than the width G1 of the image forming unit 7 in the width direction (X-axis direction). That is, the image forming apparatus 1 includes the opening 10 having (defining) a space wider than the width G1 of the image forming unit 7 at least in the width direction (X-axis direction). The opening 10 is disposed below the image forming unit 7 in the image forming apparatus 1.

The opening 10 is provided across a lower side of the image forming unit 7 to a lower side of the jam processing unit 8 arranged side by side with the image forming unit 7. The jam processing unit 8 is disposed at the right side of the image forming unit 7.

Thus, the opening 10 has a sufficient length in the width direction (X-axis direction). That is, the opening 10 is wider in the width direction (X-axis direction) than the image forming unit 7 in the image forming apparatus 1. When a user in the wheelchair operates the image forming unit 7 and surrounding members of the image forming unit 7 in the image forming apparatus 1, a user in a wheelchair can extend the hand in the width direction (X-axis direction) and operates the image forming unit 7, each sheet trays 9 and each surrounding members of the image forming unit 7 while inserting the footrest of the wheelchair inside the opening 10.

Further, a user in a wheelchair can rotate the wheelchair or move the wheelchair in the width direction (X-axis direction) of the image forming apparatus 1 while inserting a part of the wheelchair, for example, the footrest inside the opening 10. For example, if the width of the opening 10 is about the same as the width of the image forming unit 7, a user in the wheelchair has to move the footrest of the wheelchair out of the opening 10 every time to manipulate a member located beside the image forming unit 7 or to see a slightly different direction while operating the image forming unit 7. According to the configuration of the present disclosure, a user can perform various operations while stay close to the image forming apparatus 1.

The width W10 of the opening 10 is wider than a width of a sheet storage size T1, T2, and T3 of each of the sheet trays 9A, 9B, and 9C in the width direction (X-axis direction). In other words, the image forming apparatus 1 includes the openings 10 defining a space having a width wider than each of the sheet trays 9 at least in the width direction (X-axis direction) under the sheet trays 9A, 9B, and 9C. It can be said that the opening 10 is wider than the sheet storage size T1, T2, and T3 of the sheet tray 9 having the widest width in the width direction (X-axis direction) among the sheet trays 9A, 9B, and 9C of the image forming apparatus 1.

The width W10 of the opening 10 is wider than the width of each of the sheet trays 9. Thus, the image forming apparatus 1 includes the opening 10 below the sheet tray 9, and the opening 10 defines a space wider than the sheet tray 9 at least in the width direction (X-axis direction). The opening 10 extends from the lower side of the sheet tray 9A to the lower side of the sheet tray 9B (or jam processing unit 8) arranged side by side with the sheet tray 9A. The sheet tray 9B is disposed at the right side of the sheet tray 9A.

As described above, in the image forming apparatus including the image forming unit 7 to form an image on the recording medium, the image forming apparatus 1 includes the opening 10 defining a space in the front face of the image forming apparatus 1. The opening 10 is disposed below the image forming unit 7. Further, the width W10 of the opening 10 is wider than the width G1 of the image forming unit 7 in the width direction (X-axis direction). Therefore, a user in a wheelchair can approach and operate the image forming apparatus 1 while facing the front face of the image forming apparatus 1.

The opening 10 is formed as a part of the front face of the exterior housing 12 of the image forming apparatus 1. At least one end of the image forming unit 7 in the width direction (X-axis direction) forms a part of a side face of the exterior housing 12.

Further, the opening 10 and the image forming unit 7 are stacked in the height direction (Y-axis direction). Further, a part of the opening 10 and a part of the image forming unit 7 overlap in the lateral (width) direction (X-axis direction). The jam processing unit 8, and sheet trays 9B and 9C as a sheet takeout space are stacked on a region of the opening 10 excluding a partially overlapped region between the opening 10 and the image forming unit 7 in the width direction (X-axis direction).

A manner of "stacking" of the opening 10 and the image forming unit 7 in the height direction (Y-axis direction) is not limited to a configuration in which the opening 10 and the image forming unit contact each other. For example, the opening 10 and the image forming unit 7 may be stacked with other members interposed between the opening 10 and the image forming unit 7.

The width "W" of the image forming apparatus 1 is set to, for example, 600 mm or more and 900 mm or less in the present disclosure. Thus, it is possible to provide the opening 10 having the width W10 sufficient to accommodate the footrest of the wheelchair. Further, the image forming apparatus 1 does not protrude into an original path when the image forming apparatus 1 is installed in the office.

FIG. 3 is a cross-sectional side view of the image forming apparatus 1 according to a first embodiment of the present disclosure. FIG. 3 is a cross-sectional view along line A-A of the first embodiment illustrated in FIG. 2B. "H" is a height of the bottom plate 13 from a floor. "H" is also a height of the lower end 102 of the opening 10 from the floor. "HL" is a height from the floor to a bottom portion 91C of the lowest sheet tray 9C from the floor. "D10" represents a size of the opening 10 in the depth direction (Z-axis direction). The automatic document feeder 3 includes a back side reading unit 33 that reads an image on a back surface of the document to be conveyed (a lower side of the document placed on the document stacker 3A) and a front side reading unit 34 that reads an image on an upper surface of the document to be conveyed (an upper side of the document placed on the document stacker 3A).

While the document placed on an upper portion of the automatic document feeder 3 by a user is conveyed along a path indicated by arrow "d", the image on the back surface of the document is read when the document passing through the back side reading unit 33. Then, the image on the upper surface of the document is read when the document is passed through the front side reading unit 34. With such a configuration, it is possible to read images on both sides of the document while conveying one document one time in one direction. Further, a conveyance path of the document with such a configuration is shorter than a conveyance path in which the sheet is conveyed in two or more directions for one document. Thus, the image forming apparatus 1 according to the present disclosure can reduce jamming the automatic document feeder 3 and improve operability of the image forming apparatus 1. Such a configuration may be referred to as "single-pass duplex scanning".

"H" is lower than 50 mm which is a height of a foot support of the wheelchair specified in JIS_T9201 as an example. Further, D10 is equal to or greater than a length of a foot support of the wheelchair as prescribed in JIS_T9201. With such a configuration, a user in a wheelchair can approach and operate the image forming apparatus 1 without hitting the footrest of the wheelchair on the image forming apparatus 1.

Further, HL is, for example, 300 mm or more. With such a configuration, a user in a wheelchair can approach and operate the image forming apparatus 1 such as opening and closing the sheet tray 9 without hitting the footrest of the wheelchair on the image forming apparatus 1.

In the image forming apparatus 1 in the present disclosure as illustrated in FIG. 1, the opening 10 is continuously formed from the lower side of the first sheet tray 9A to the lower side of the second sheet tray 9C. Thus, as illustrated in FIG. 3, a user in a wheelchair can perform various operations of the image forming apparatus 1 at substantially center position of the image forming apparatus 1 while inserting the footrest inside the opening 10.

Specifically, the operation unit 4 is located substantially at a center of the image forming apparatus 1, and the operation unit 4 is operable substantially at a front face of the operation unit 4. Further, a user can reach and operate both of the left sheet tray 9A and the right sheet tray 9B or 9C of the sheet trays 9 arranged laterally in the width direction (X-axis direction) across the conveyance path 70 located near the center of the image forming apparatus 1.

Further, the user can reach both of the image forming unit 7 and the jam processing unit 8 to exchange parts of the image forming unit 7 and to process the jam in the jam processing unit 8. The image forming unit 7 and the jam processing unit 8 are arranged side by side with a central portion of the image forming apparatus 1 in between. Thus, a user can reach and operate both the scanner 2 and the automatic document feeder 3 arranged side by side with the central portion of the image forming apparatus 1 in between.

Figure 4:
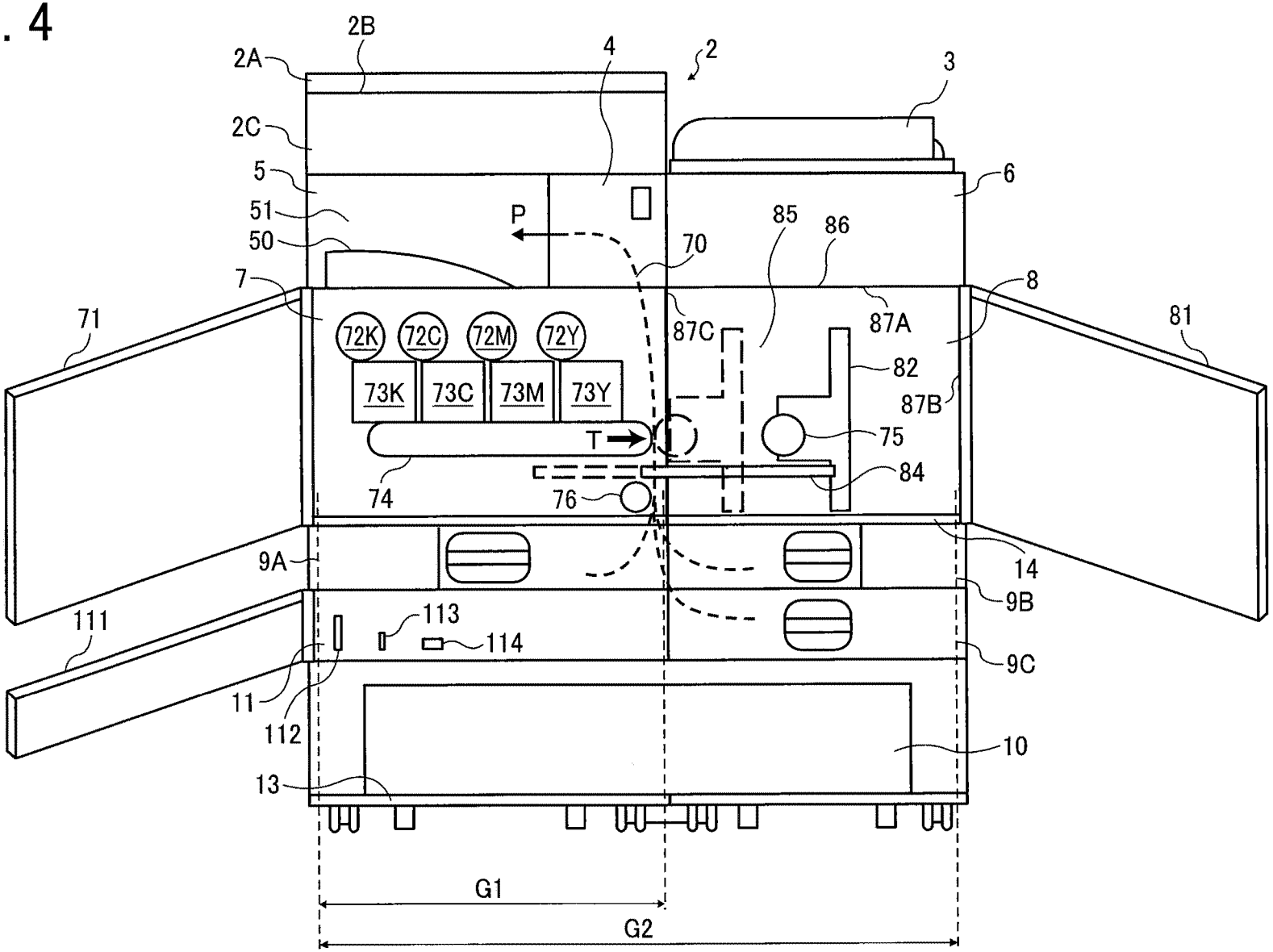
FIG. 4 is a front view of an internal configuration of the image forming apparatus according to the first embodiment.

FIG. 4 is a front view of an internal configuration of the image forming apparatus 1. The image forming apparatus 1 includes an openably closable member 71 (openably closable cover) to open an inside of the image forming unit 7, an openably closable member 81 to expose an inside of the jam processing unit 8, and an openably closable member 111 to expose an inside of the electrical component housing 11.

The image forming unit 7 is supported by a support 14 in the image forming apparatus 1. A width G2 of the support 14 is wider than a width G1 of the image forming unit 7 in the width direction (X-axis direction). A spaces is provided below the support 14. The opening 10 is an example of the space. The image forming unit 7 includes toner bottles 72K, 72C, 72M, and 72Y that store toners of respective colors of black, cyan, magenta, and yellow, and image forming units 73K, 73C, 73M, and 73Y to form images of respective colors of black, cyan, magenta, and yellow using toners supplied from the toner bottles 72K, 72C, 72M, and 72Y.

The image forming unit 7 further includes an intermediate transfer unit 74, a secondary transfer roller 75, and registration roller 76 inside the image forming unit 7. The intermediate transfer unit 74 transfers the images of respective colors formed by the image forming units 73K, 73C, 73M, and 73Y. The secondary transfer roller 75 secondarily transfers the toner image transferred from the intermediate transfer unit 74 onto the sheet conveyed along the conveyance path 70. The registration roller 76 conveys the sheet to the secondary transfer roller 75.

The jam processing unit 8 includes a jam processing cover 82, a slide rail 84, a jam processing space 85, and a takeout opening 86 (jam processing opening). The jam processing cover 82 is a conveyance cover to cover the conveyance path 70 at least during image formation. The slide rail 84 slides and moves the jam processing cover 82. The jam processing space 85 is a space (enclosure) to take out sheet (sheet takeout space) to enable a user to remove the sheet from the conveyance path 70 and process the jamming. The takeout opening 86 (jam processing opening) opens the jam processing space 85 to the front face of the image forming apparatus 1.

The jam processing unit 8 is a space (enclosure) arranged side by side with the image forming unit 7. For example, the space of the jam processing unit 8 is defined by a ceiling 87A, a side wall 87B and 87C, and a support 14 that are a part of the exterior housing 12. A space is provided below the support 14. The opening 10 is an example of the space. The jam processing unit 8 as an example of a space arranged side by side with the image forming unit 7 is located above the support 14. As described above, the length G2 in the width direction of the support 14 is longer than the length G1 in the width direction of the image forming unit 7.

The image forming unit 7 has the space arranged side by side with the jam processing unit 8 in the lateral (width)

direction (X-axis direction). Thus, a lateral width of the image forming apparatus 1 expands, and it thus becomes possible to provide the opening 10 having a sufficient space for, for example, a user in a wheelchair to place the footrest inside the space of the opening 10.

The secondary transfer roller 75 is attached to the jam processing cover 82. With a movement of the jam processing cover 82, the secondary transfer roller 75 is movable between a secondary transfer position to secondary transfer the image onto the sheet and an opening position to open the conveyance path 70. In FIG. 4, the secondary transfer roller 75, the jam processing cover 82, and the slide rail 84 are indicated by solid lines illustrate the opening position. In FIG. 4, the secondary transfer positions of the secondary transfer roller 75, the jam processing cover 82, and the slide rail 84 are indicated by dash-dotted line.

The electrical component housing 11 is arranged side by side with the sheet tray 9C and to overlap with the sheet tray 9C in the height direction (Y-axis direction in FIG. 1). The electrical component housing 11 includes an SD card insertion port 112, a USB memory insertion port 113, and a LAN cable connection port 114. A Secure Digital (SD) card as a storage medium is insertable in the SD card insertion port 112. A Universal Serial Bus (USB) memory as a storage medium is insertable in the USB memory insertion port 113. A Local Area Network (LAN) cable is connectable to the LAN cable connection port 114. The SD card insertion port 112, the USB memory insertion port 113, and the LAN cable connection port 114 are provided on the front face of the image forming apparatus 1.

With such a configuration, a user performing another operation at the front face of the image forming apparatus 1 can also operate the electrical component housing 11. Further, if the electrical parts are stored on the back side of the image forming apparatus 1, for example, a depth of the image forming apparatus 1 in the Z-axis direction is increased. Conversely, the electric parts are stored in the electrical component housing 11 overlapped with the sheet tray 9 and the image forming unit 7 in the height direction (Y-axis direction). Thus, a degree of freedom of layout of the image forming apparatus 1 is increased, and for example, the depth of the image forming apparatus 1 in the Z-axis direction can be reduced.

If the depth of the image forming apparatus 1 in the Z-axis direction is large, a problem may occur such that it is difficult for the user to see the back side of the image forming apparatus 1, or the user cannot reach and open the automatic document feeder 3 by the hands depending on the height of a wheelchair or a user. The image forming apparatus 1 according to the present disclosure reduces the depth of the image forming apparatus 1 in the Z-axis direction to increase convenience of the user. To increase the capacity of the sheets stored in the image forming apparatus 1, an additional sheet tray 9 may be provided in place of the electrical component housing 11 at a portion in which the electrical component housing 11 is disposed.

An image formation on the sheet of the image forming unit 7 is described with reference to FIG. 4. The sheets stored in the sheet trays 9A, 9B, and 9C are conveyed to the image forming unit 7 along the conveyance path 70 as a sheet conveyance section, and an image is formed on the sheets by the image forming unit 7. The sheet on which the image is formed is further conveyed along the conveyance path 70 and ejected to the ejection unit 5.

The conveyance path 70 is provided between the sheet tray 9A and 9C, and between the sheet tray 9C and 9B in the width direction (X-axis direction) so that the conveyance path 70 vertically passes through an area between the sheet tray 9A and 9C, and between the sheet tray 9C and 9B in the width direction (X-axis direction). While the sheet is conveyed along the conveyance path 70 in the height direction (Y-axis direction), images are formed onto the sheets on the conveyance path 70 from either a left side or a right side in the width direction (X-axis direction) by the image forming unit 7. In FIG. 4, an image is applied (formed) onto the sheet conveyed along the conveyance path 70 from the left side in the width direction (X-axis direction), that is, the direction indicated by the arrow "T".

The sheets S1 are stored in the sheet trays 9A, 9B, and 9C so that each surfaces of the sheet S1 faces vertically (faces upward or downward). Thus, in FIG. 4, an image is applied to an upper surface of the sheet S1 stored in the sheet tray 9A, the upper surface of the sheet S1 facing upward when the sheet S1 is stored in the sheet tray 9A. Then, an image is applied to a lower surface of the sheet S1 stored in the sheet tray 9B and 9C, and the lower surface of the sheet S1 facing downward when the sheet S1 is stored in the sheet tray 9B and 9C arranged side by side with the sheet tray 9A. The lower surface is opposite the upper surface.

The image may be applied to the sheet S1 by the image forming unit 7 from the right side of the conveyance path 70. Then, an image is applied to a lower surface of the sheet S1 stored in the sheet tray 9A, the lower surface of the sheet S1 facing downward when the sheet S1 is stored in the sheet tray 9A. Then, an image is applied to a lower surface of the sheet S1 stored in the sheet tray 9B and 9C, and the upper surface of the sheet S1 facing upward when the sheet S1 is stored in the sheet tray 9B and 9C arranged side by side with the sheet tray 9A. The upper surface is opposite the lower surface.

Since the conveyance path 70 is configured as described above, a first surface, on which the image is formed by the forming unit 7, of the sheet stored in a first sheet tray 9 and a second surface, on which the image is formed by the forming unit 7, of the sheet stored in a second sheet tray 9 are opposite surfaces in vertical direction when the sheets are stored in the first sheet tray 9 or the second sheet tray 9. With such a configuration, the image forming apparatus 1 can efficiently form an image onto the sheet S1 within the width "W" of the image forming apparatus 1.

A jam processing is described with reference to FIG. 4. The jam processing space 85 is disposed within a size of the width "W" of the image forming apparatus 1. For example, the jam processing space 85 is arranged above one of a plurality of sheet trays 9. With such a configuration, a user can operate the sheet tray 9 and can take out (remove) the sheet S1 from the conveyance path 70 within the size of the width "W" of the image forming apparatus 1.

The jam processing cover 82 is movable in the jam processing space 85. The jam processing cover 82 is a conveyance cover. For example, the jam processing cover 82 can move between a closing position to cover the conveyance path 70 and an opening position to open the conveyance path 70 to the jam processing space 85. Thus, the conveyance path 70 can be openably closable to the jam processing space 85. With such a configuration, it is possible to open the conveyance cover (jam processing cover 82) within the width "W" of the image forming apparatus 1 to operate the sheet tray 9 or to remove the sheet from the conveyance path 70.

Further, the jam processing space 85 includes a takeout opening 86 opened on the front face of the image forming apparatus 1. With such a configuration, a user can perform a jam process together with other operations on the front face of the image forming apparatus 1.

The openably closable member 81 can open the takeout opening 86 to outside the image forming apparatus 1. With such a configuration, the sheet takeout space (jam processing unit 8 or jam processing space 85) can be closed except when the sheet S1 removed from the conveyance path 70. Thus, the image forming apparatus 1 according to the present disclosure can protect an interior of the image forming apparatus 1 and improve the external appearance.

In FIG. 4, the image forming unit 7 adopting so-called full-color electrophotographic method is described as an example. However, an image forming method of the image forming unit 7 is not limited to the above-described methods and may be any other suitable methods. For example, the image forming unit 7 may adopt a monochrome electrophotographic method to form a monochrome image on the sheet using only black toner. The image forming unit 7 may adopt an inkjet method including an inkjet head that discharges ink onto the sheet to form an image on a sheet conveyed from each sheet tray 9.

Figure 5:
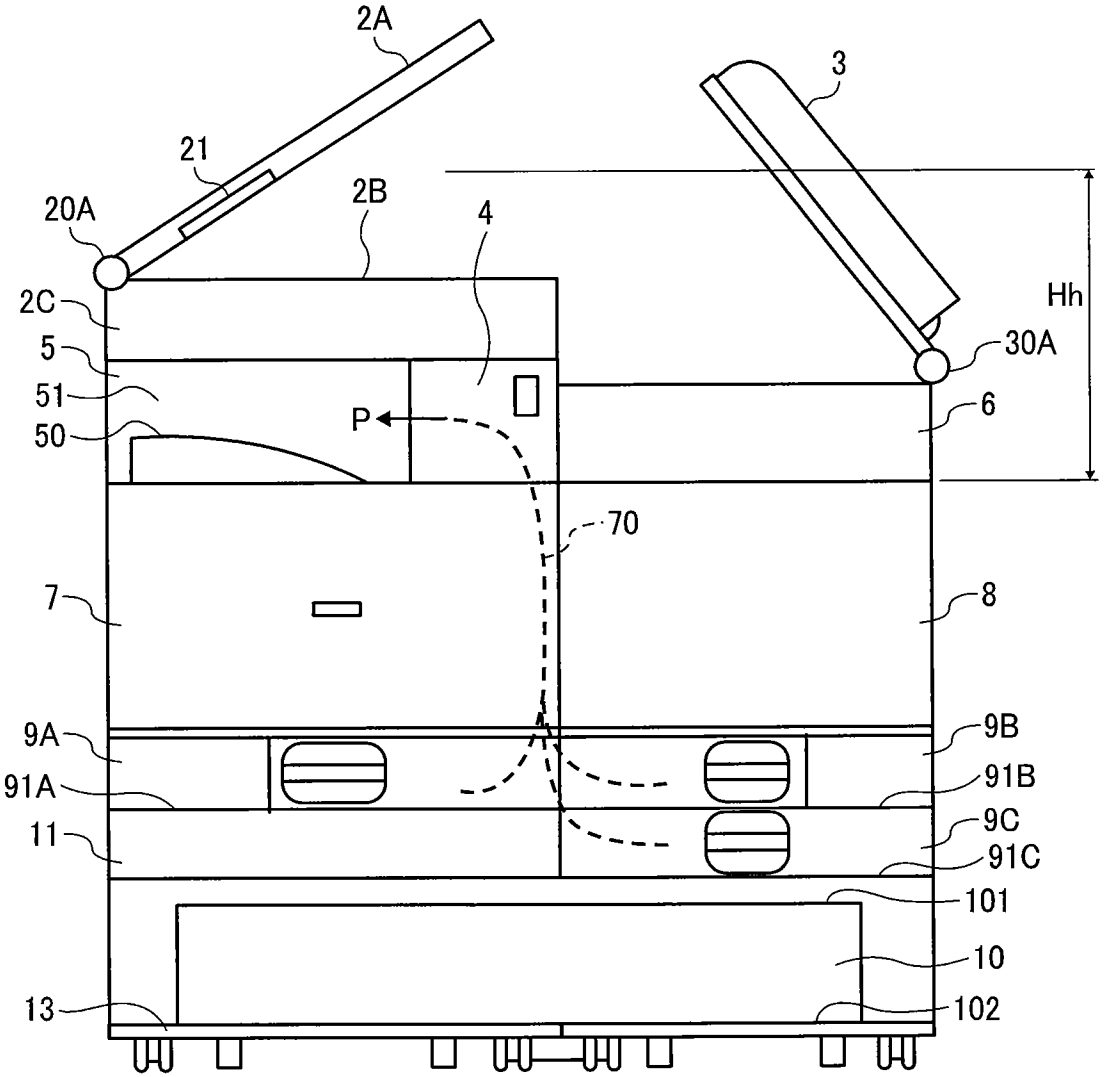
FIG. 5 is a front view of a first example of the image forming apparatus according to the first embodiment.

FIG. 5 is a front view of the image forming apparatus 1 according to the first embodiment of the present disclosure. FIG. 5 illustrates a situation in which the image forming apparatus 1 is in use. The scanner 2 includes a pressure plate shaft 20A that rotatably supports the pressure plate 2A and a pressure plate holder 21. The image forming apparatus 1 includes a support shaft 30A that rotatably supports the automatic document feeder 3.

"Hh" is a height of an operating position of the pressure plate 2A or the automatic document feeder 3 to a lower end of the ejection unit 5 when the pressure plate 2A or the automatic document feeder 3 is opened. "Hh" can also be a range in the height direction (Y-axis direction) in which a user moves the hand to operate the ejection unit 5, the pressure plate 2A of the scanner 2, and the automatic document feeder 3 FIG. 5 illustrates a case in which the pressure plate 2A and the automatic document feeder 3 are in the opened position.

The pressure plate shaft 20A is disposed at the left end of the image forming apparatus 1 in the width direction (X-axis direction). An axial direction of the pressure plate shaft 20A is parallel to the depth direction (Z-axis direction in FIG. 1) of the image forming apparatus 1. The pressure plate 2A is rotatable around the pressure plate shaft 20A with respect to the reading unit 2B, the scanner body 2C, and the image forming apparatus 1. The pressure plate 2A is openably closable to the reading unit 2B with the rotation of the pressure plate 2A. A user can easily operate the pressure plate 2A by holding the pressure plate holder 21.

As a comparative example, the axial direction of the pressure plate shaft 20A may be arranged along the width direction (X-axis direction) of the image forming apparatus 1. Then, a front end of the pressure plate 2A moves away from the front face of the image forming apparatus 1 in the depth direction (Z-axis direction) as a degree of opening of the pressure plate 2A increases (as a height of the front end of the pressure plate 2A increases) when a user opens the pressure plate 2A from the front face of the image forming apparatus 1. Thus, a user may find it difficult to reach and operate the pressure plate 2A. As described above, the axial direction of the pressure plate shaft 20A is arranged along the depth direction (Z-axis direction). Thus, the image forming apparatus 1 can solve the problem in which the pressure plate 2A moves away from a user in the depth direction (Z-axis direction) so that a user has difficulty reaching and operating the pressure plate 2A.

Further, the pressure plate holder 21 is located between the pressure plate shaft 20A and an end of the pressure plate 2A opposite the pressure plate shaft 20A in the pressure plate 2A. Specifically, the pressure plate holder 21 is located closer to the pressure plate shaft 20A than a center of the pressure plate 2A between the pressure plate shaft 20A and the end of the pressure plate 2A. Preferably, an entire pressure plate holder 21 is provided at a position closer to the pressure plate shaft 20A than the center of the pressure plate 2A between the end of the pressure plate 2A and the pressure plate shaft 20A. Further, the pressure plate holder 21 is provided on the front face of the image forming apparatus 1. The image forming apparatus 1 thus can narrow the height "Hh" and reduce a range of movement of the hand of a user in the height direction (Y-axis direction).

The support shaft 30A is disposed at the right end of the image forming apparatus 1 in the width direction (X-axis direction) such that an axial direction of the support shaft 30A is parallel to the depth direction (Z-axis direction) of the image forming apparatus 1. The automatic document feeder 3 is rotatable around the support shaft 30A with respect to the loading unit 6 and the image forming apparatus 1. The automatic document feeder 3 can be openably closable to the loading unit 6 with the rotation of the automatic document feeder 3.

As a comparative example, the axial direction of the support shaft 30A may be arranged along the width direction (X-axis direction) of the image forming apparatus 1. Then, a front end of the automatic document feeder 3 moves away from the front face of the image forming apparatus 1 in the depth direction (Z-axis direction) as a degree of opening of the automatic document feeder 3 increases (as a height of the front end of the automatic document feeder 3 increases) when the user opens the automatic document feeder 3 from the front face of the image forming apparatus 1.

Thus, the user may find it difficult to reach and operate the automatic document feeder 3. Thus, the image forming apparatus 1 can solve the problem in which the automatic document feeder 3 moves away from the user in the depth direction (Z-axis direction) so that the user has difficulty reaching and operating the automatic document feeder 3 because the axial direction of the support shaft 30A is arranged along the depth direction (Z-axis direction) of the image forming apparatus 1 as described above.

Figure 6:
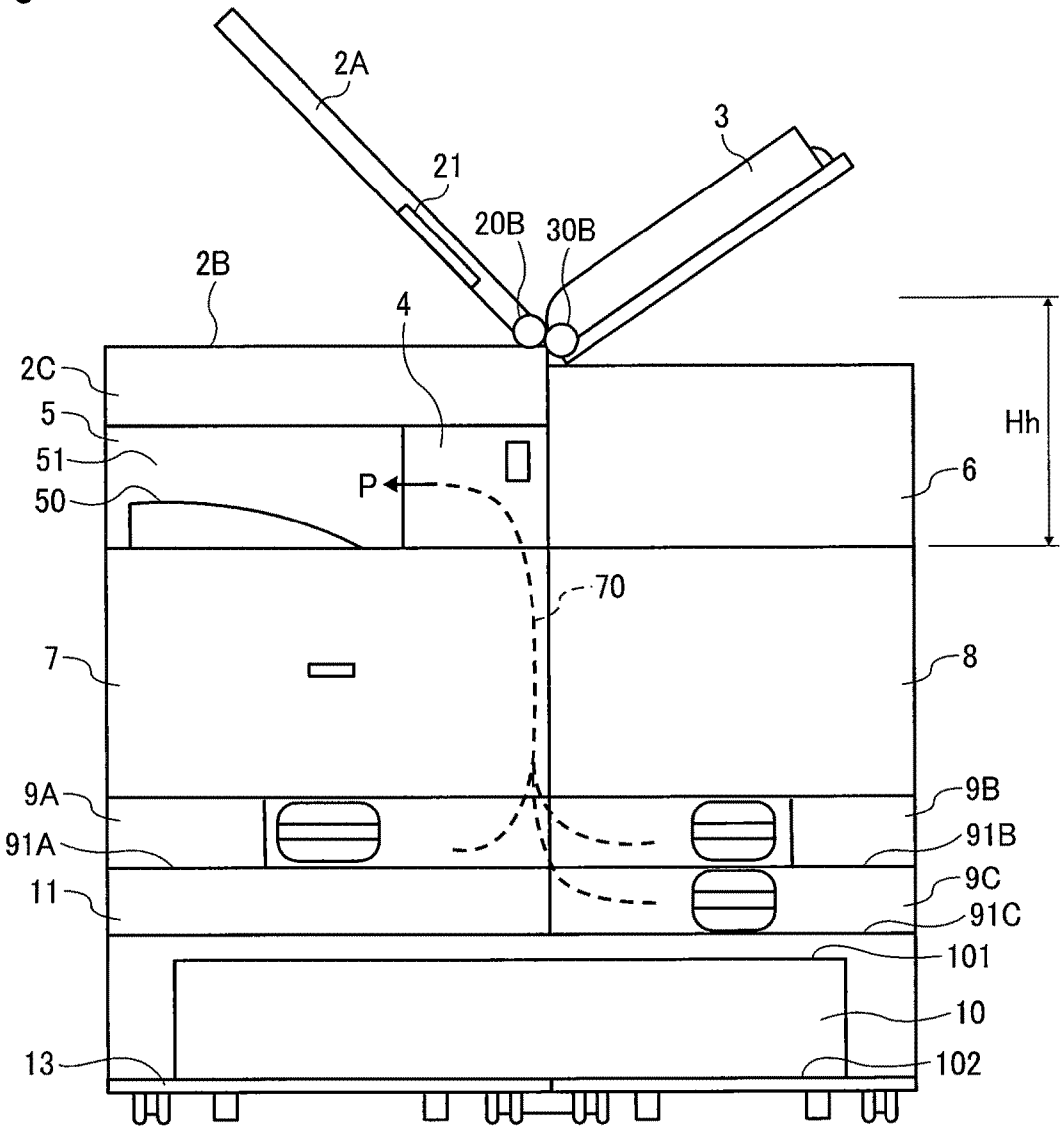
FIG. 6 is a front view of a second example of the image forming apparatus according to the first embodiment.

FIG. 6 is a front view of the image forming apparatus 1 of a second example according to the first embodiment of the present disclosure. FIG. 6 illustrates the image forming apparatus 1 in use.

The scanner 2 includes a pressure plate shaft 20B that rotatably supports the pressure plate 2A and a pressure plate holder 21. The image forming apparatus 1 includes a support shaft 30B that rotatably supports the automatic document feeder 3. As similarly to FIG. 5, FIG. 6 illustrates a case in which the pressure plate 2A and the automatic document feeder 3 are in the opened position.

The pressure plate shaft 20B is disposed at a central portion of the image forming apparatus 1 in the width direction (X-axis direction). An axial direction of the pressure plate shaft 20B is parallel to the depth direction (Z-axis direction in FIG. 1) of the image forming apparatus 1. The pressure plate 2A is rotatable around the pressure plate shaft 20B with respect to the reading unit 2B and the scanner body 2C.

As described with respect to the pressure plate shaft 20A in FIG. 6, the axial direction of the pressure plate shaft 20B is arranged along the depth direction (Z-axis direction). Thus, the image forming apparatus 1 can solve the problem in which the pressure plate 2A moves away from a user in the depth direction (Z-axis direction) so that a user has difficulty reaching and operating the pressure plate 2A.

Further, the pressure plate holder 21 is located between the pressure plate shaft 20B and an end of the pressure plate 2A opposite the pressure plate shaft 20B in the pressure plate 2A. Specifically, the pressure plate holder 21 is located closer to the pressure plate shaft 20B than a center of the pressure plate 2A between the pressure plate shaft 20B and the end of the pressure plate 2A.

Preferably, an entire pressure plate holder 21 is provided at a position closer to the pressure plate shaft 20B than the center of the pressure plate 2A between the end of the pressure plate 2A and the pressure plate shaft 20B. Further, the pressure plate holder 21 is provided on the front face of the image forming apparatus 1. The image forming apparatus 1 thus can narrow the height "Hh" and reduce a range of movement of the hand of a user in the height direction (Y-axis direction).

The support shaft 30B is disposed at the center portion of the image forming apparatus 1 in the width direction (X-axis direction) such that an axial direction of the support shaft 30B is parallel to the depth direction (Z-axis direction) of the image forming apparatus 1. The automatic document feeder 3 is rotatable around the support shaft 30B with respect to the loading unit 6 and the image forming apparatus 1.

Thus, as similarly to the support shaft 30A in FIG. 6, the image forming apparatus 1 can solve the problem in which the automatic document feeder 3 moves away from a user in the depth direction (Z-axis direction) so that a user has difficulty reaching and operating the automatic document feeder 3 because the axial direction of the support shaft 30B is arranged in the depth direction (Z-axis direction) of the image forming apparatus 1.

Figure 7:
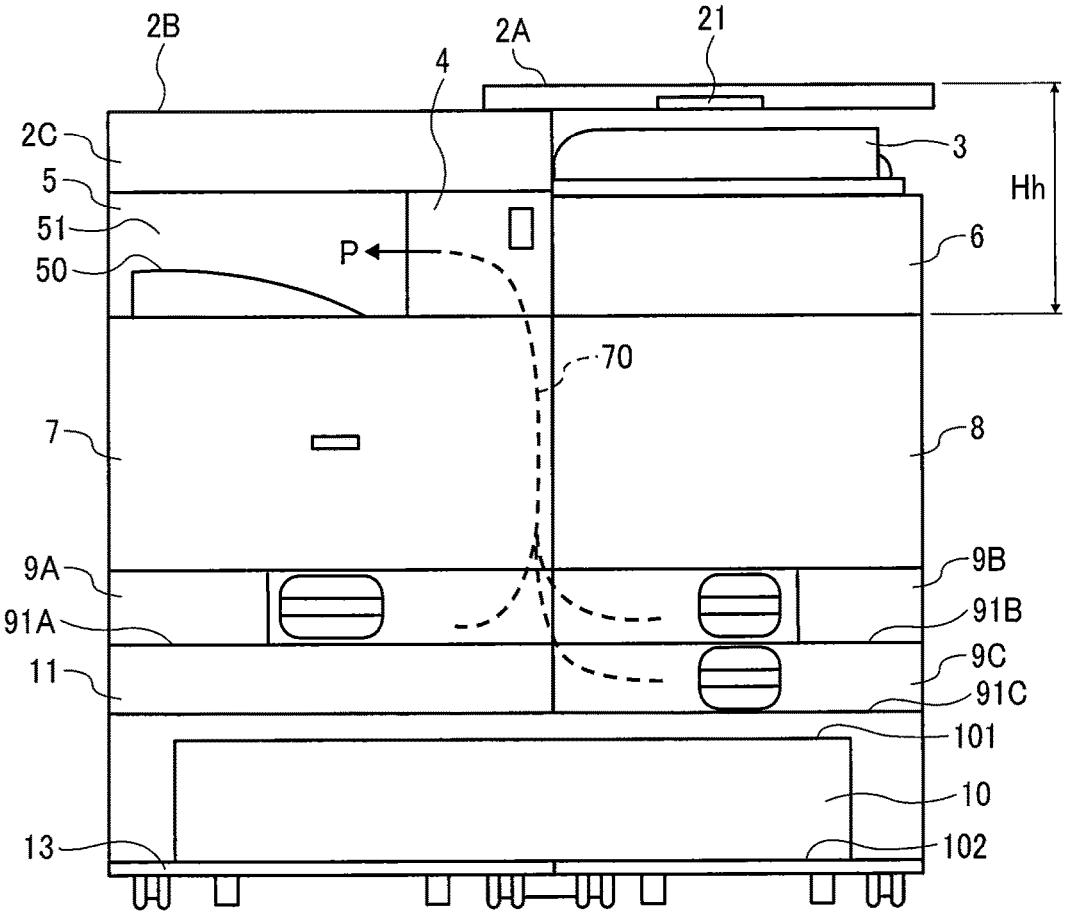
FIG. 7 is a front view of a third example of the image forming apparatus according to the first embodiment.

FIG. 7 is a front view of the image forming apparatus 1 of a third example according to the first embodiment of the present disclosure. FIG. 7 illustrates the image forming apparatus 1 in use.

The scanner 2 holds the pressure plate 2A slidably movable with respect to the reading unit 2B and the scanner body 2C. An upper end of the automatic document feeder 3 is arranged below a lower end of the pressure plate 2A. The pressure plate 2A is slidable in the width direction (X-axis direction) of the image forming apparatus 1 from a first position above the reading unit 2B and the scanner body 2C to a second position above the automatic document feeder 3. That is, the pressure plate 2A slidably moves between the first position and the second position above the ejection unit 5 and the automatic document feeder 3 in the width direction (X-axis direction).

"Hh" is a height of an operation position of the pressure plate 2A from a lower end of the ejection unit 5. The pressure plate 2A slides at the height "Hh" in the width direction (X-axis direction) with respect to the reading unit 2B and automatic document feeder 3. Thus, the pressure plate 2A is openably closable to the reading unit 2B with a slidable movement of the pressure plate 2A. Further, a configuration of sliding the pressure plate 2A within a size of the image forming apparatus 1 in the width direction (X-axis direction) can save space in the width direction (X-axis direction) of the image forming apparatus 1.

Figure 8:
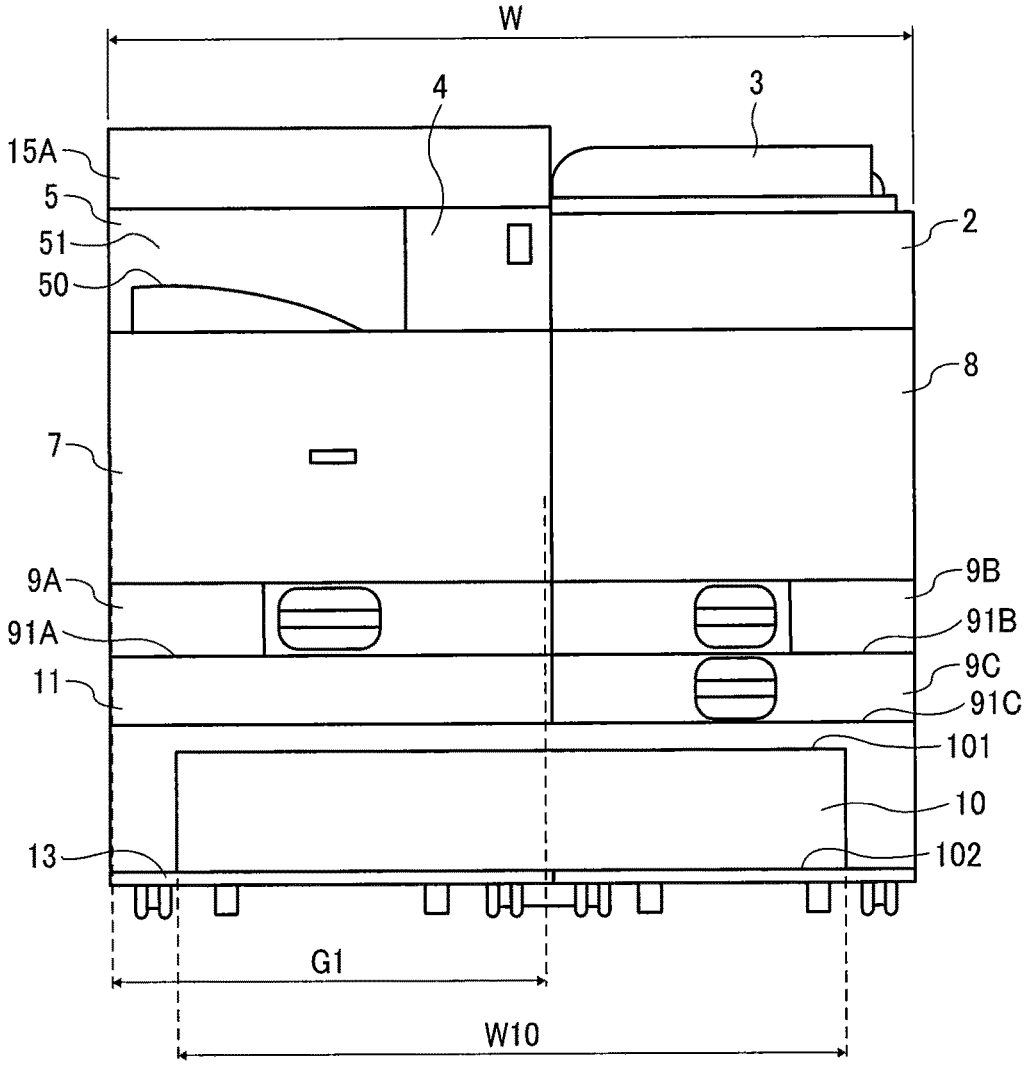
FIG. 8 is a front view of an image forming apparatus according to a second embodiment of the present disclosure.

FIG. 8 is a front view of the image forming apparatus 1 according to a second embodiment of the present disclosure.

The image forming apparatus 1 includes a top plate 15A at an upper portion of the ejection unit 5. The top plate 15A is fixed to the upper portion of the ejection unit 5. The image forming apparatus 1 includes a scanner 2 between the automatic document feeder 3 and the jam processing unit 8 in place of the loading unit 6 as illustrated in FIG. 2. The top plate 15A fixed to the upper portion of the ejection unit 5 is a plate-like member.

The top plate 15A arranged at the upper portion of the ejection unit 5 can reduce leakage of sound, odor, etc. from the ejection unit 5. The top plate 15A provided at the top of the image forming apparatus 1 enable a user to perform desired work on the top plate 15A. An internal configuration of the image forming unit 7 and the jam processing unit 8 illustrated in FIG. 8 is the same as the internal configuration as illustrated in FIG. 4.

As illustrated in FIG. 8, a main body of the image forming apparatus 1 (interior configuration of the image forming apparatus 1) includes the first region (left side region) and second region (right side region) arranged side by side with the first region in the lateral (width) direction (X-axis direction) of the exterior housing 12 in view from front side of the image forming apparatus 1 (view from Z-axis direction in FIG. 1).

The top plate 15A, the ejection unit 5, the image forming unit 7, and the sheet tray 9A are provided in the first region. The automatic document feeder 3, the scanner 2, the jam processing unit 8, and the sheet trays 9B and 9C are provided in the second region. Here, the image forming unit 7 in the first region and the jam processing unit 8 in the second region overlaps in the height direction (Y-axis direction in FIG. 1) of the image forming apparatus 1 and are arranged side by side in the lateral (width) direction (X-axis direction). Thus, a part of the first region and a part of the second region overlap in the height direction.

Thus, the opening 10 disposed below the main body of the image forming apparatus 1 includes the first region in which the image forming unit 7 is provided and the second region in which the scanner 2, etc., is provided.

Figure 9A:
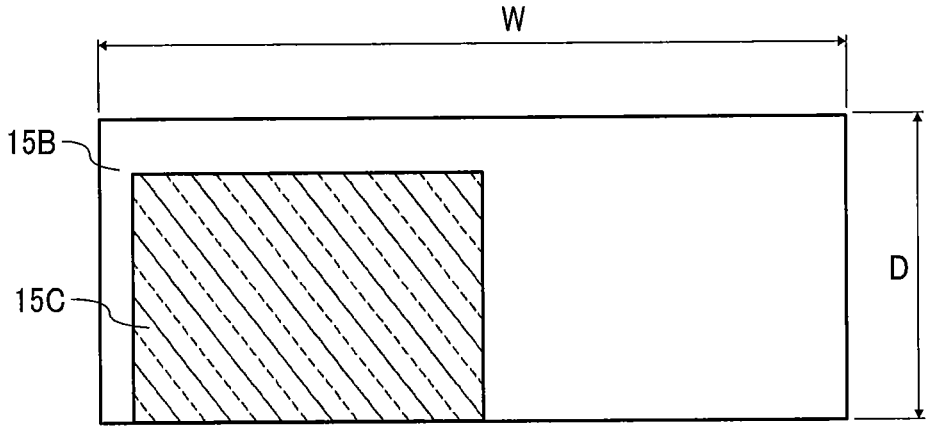
FIGS. 9A and 9B are a front view of the image forming apparatus according to a third embodiment.
Figure 9B:
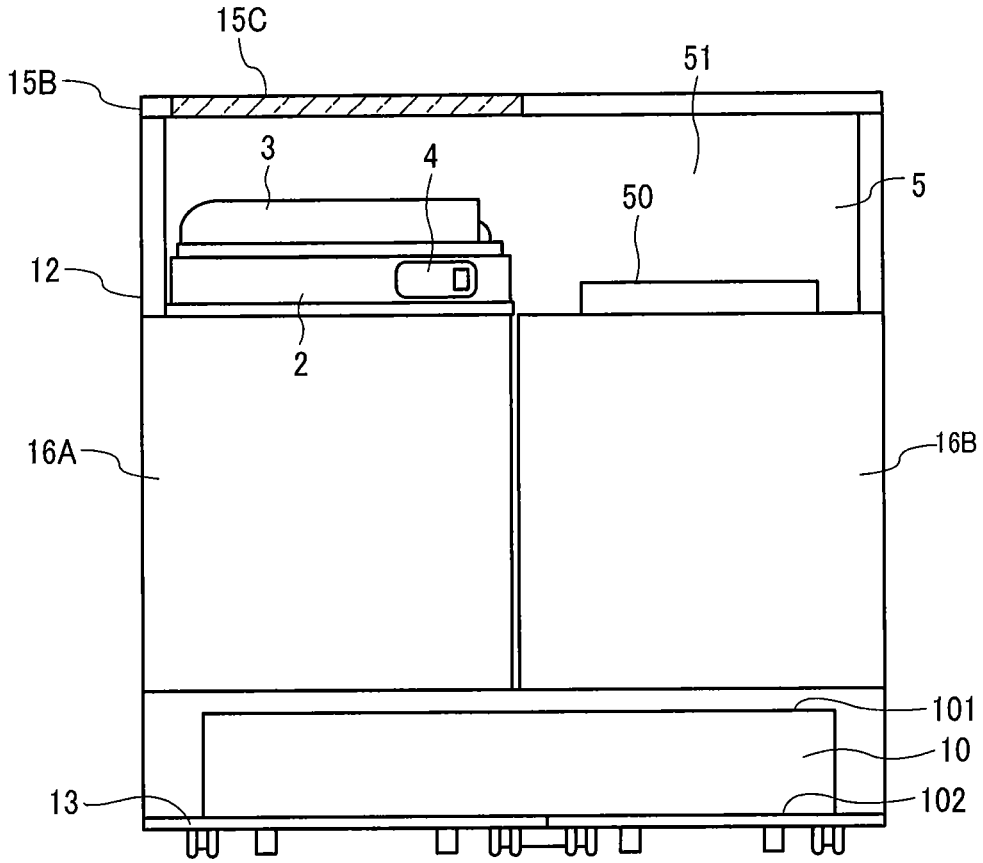

A third embodiment is described with reference to FIGS. 9A and 9B. FIG. 9B is a front view of the image forming apparatus 1 according to the third embodiment of the present disclosure. FIG. 9A is a top view of the image forming apparatus 1, and FIG. 9B is a front view of the image forming apparatus 1.

As illustrated in FIGS. 9A and 9B, the image forming apparatus 1 includes a top plate 15B, a top plate 15C, a left front door 16A, and a right front door 16B. The operation unit 4 is provided outside the scanner 2 and near the center of the image forming apparatus 1 in the width direction (X-axis direction). In the present embodiment, the sheet S1 is conveyed from a back face to a front face of the image forming apparatus 1 to a sheet stacker 50 on which the sheet S1 on which the image is formed is stacked.

The top plate 15B is fixedly supported by the exterior housing 12 as an example and covers the uppermost part of the image forming apparatus 1. The top plates 15B and 15C are plate-like members. As illustrated in FIG. 9A, a portion of the top plate 15B is cut out, and the portion cut out from the top plate 15B is occupied by the top plate 15C so that a top plate 15C is supported by the top plate 15B. The top plate 15C is formed of a transparent member. For example, the top plate 15C is made of an acrylic plate. Thus, a user can visually recognize a presence of the automatic document feeder 3 via the top plate 15C from above the image forming apparatus 1.

The left front door 16A covers a left side of the front face of the image forming apparatus 1 and is a door openably closable by a user. The right front door 16B covers a right side of the front face of the image forming apparatus 1 and is a door openably closable by a user.

Figure 10:
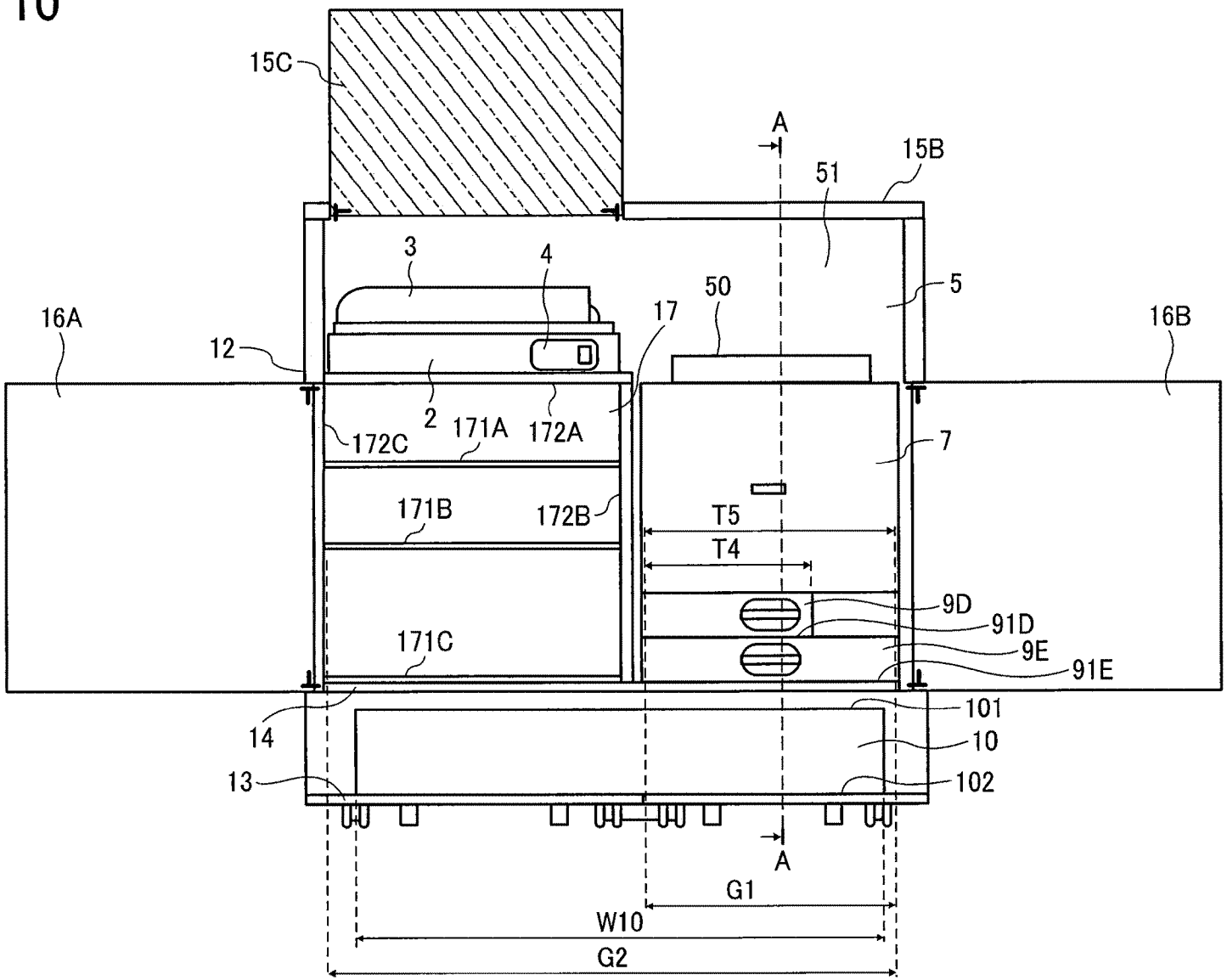
FIG. 10 is a front view of a first example of an internal configuration of the image forming apparatus according to the third embodiment.

Next, with reference to FIG. 10, an internal configuration of the image forming apparatus 1 is described. FIG. 10 is a front view of a first example of the internal configuration of the image forming apparatus 1 according to the third embodiment. In FIG. 10, the left front door 16A and the right front door 16B are opened to illustrate the internal configuration of the image forming apparatus 1. A user can open the top plate 15C upward to make the scanner 2 and the automatic document feeder 3 operable.

The image forming unit 7 and the sheet trays 9D and 9E are provided inside the interior of the image forming apparatus 1, the right front door 16B of which is opened. The image forming unit 7 and the sheet trays 9D and 9E are arranged close to the right side of the exterior housing 12. Further, the image forming unit 7 is supported by the support 14 via the sheet trays 9D and 9E. A width W10 of the opening 10 is wider than a width G1 of the image forming unit 7 in the width direction (X-axis direction). A length G2 of the support 14 is longer than the width G1 of the image forming unit 7 in the width direction (X-axis direction).

The image forming unit 7 and the sheet trays 9D and 9E may be formed together to be one body to form an image forming device. Thus, the image forming device including the image forming unit 7 and the sheet trays 9D and 9E is disposed in a space provided inside the image forming apparatus 1.

The ejection unit 5 is provided above the image forming unit 7. The sheet trays 9D and 9E are drawable toward the front face of the exterior housing 12 of the image forming apparatus 1 in the Z-axis direction as illustrated in FIG. 1. The sheet trays 9D and 9E are provided below the image forming unit 7.

The image forming apparatus 1 includes a storage 17 in an interior of the left front door 16A. The storage 17 includes shelves 171A, 171B and 171C. Thus, a user can place desired items such as a sheet before use and a supply item used in the image forming apparatus 1 in the shelves 171A, 171B, and 171C. The storage 17 is a space (enclosure) arranged side by side with the image forming unit 7 and is provided on a left side of the image forming unit 7. For example, the storage 17 is a space (enclosure) partitioned by a ceiling 172A, side walls 172B and 172C, and a support 14 forming a part of the exterior housing 12. The storage 17 is supported by a region of the support 14 excluding a region of the support 14 that supports the image forming unit 7 in the width direction (X-axis direction).

As illustrated in FIG. 10, a main body of the image forming apparatus 1 (interior configuration of the image forming apparatus 1) includes the first region (right side region) and second region (left side region) arranged side by side with the first region in the lateral (width) direction (X-axis direction) of the exterior housing 12 in view from front side of the image forming apparatus 1 (view from Z-axis direction in FIG. 1).

The top plate 15B, the ejection unit 5, the image forming unit 7, and the sheet tray 9D and 9E are provided in the first region. The top plate 15C, the automatic document feeder 3, the scanner 2, and the storage 17 are provided in the second region.

Here, the image forming unit 7 in the first region and the storage 17 in the second region overlaps in the height direction (Y-axis direction in FIG. 1) of the image forming apparatus 1 and are arranged side by side in the lateral (width) direction (X-axis direction). Thus, a part of the first region and a part of the second region overlap in the height direction. The storage 17 is another example of the space in the exterior housing 12.

Similarly to the sheet trays 9A, 9B, and 9C in FIG. 1, the image forming apparatus 1 in FIG. 10 includes the sheet trays 9D and 9E that stack sheets to be conveyed to the image forming unit 7. For example, the sheet tray 9D stores sheets having a size of A4, and the sheet tray 9E stores sheets having a size of A3. Hereinafter, the sheet trays 9D and 9E may be simply referred to as a "sheet tray 9" when it is unnecessary to distinguish the sheet trays 9D and 9E from each other.

Here, the relative positions of the plurality of sheet trays 9D and 9E, and the opening 10 are described below. The sheet tray 9D has a bottom 91D and the sheet tray 9E has a bottom 91E. The bottom 91E of the sheet tray 9E is the lowest among the bottom 91D and the bottom 91E. The opening 10, more specifically, the opening upper end 101 is located below the bottom 91E of the sheet tray 9E that is the lowest bottom among the bottoms 91D and 91E of the sheet trays 9D and 9E. The image forming apparatus 1 with such a configuration as illustrated in FIG. 1 enable the user to easily operate the image forming apparatus 1. For example, the operability of the lowest sheet tray 9E is improved.

Further, the opening 10 is formed between the storage 17 and the image forming unit 7. Specifically, the opening 10 is formed between a portion below the storage 17 (below the shelf 171C) and a portion below the lowest sheet tray 9E that is located below the image forming unit 7 and the sheet tray 9D. Thus, the opening 10 is formed across a portion below the storage 17 to a portion below the sheet tray 9E (below the image forming unit 7 or the sheet tray 9D).

Thus, it can be said that the opening 10 extends continuously from the portion below the storage 17 to the portion below the sheet tray 9E (below the image forming unit 7 or the sheet tray 9D). With such a configuration, a user in a wheelchair or the like can insert the footrest of the wheelchair inside the opening 10 to easily operate each part of the image forming apparatus 1.

A configuration of the front face of the image forming apparatus 1 is described below. In FIG. 1, the front face of each sheet trays 9 in a state in which the sheet trays 9A, 9B, and 9C are accommodated inside the image forming apparatus 1 and the front face of the exterior housing 12 are substantially in the same plane, for example. That is, a portion of the exterior housing 12 forming the opening 10 and the front surface of each sheet trays 9A to 9C accommodated inside the image forming apparatus 1 are substantially in the same plane.

"T4" is a storage size of the sheet of the sheet tray 9D in the width direction (X-axis direction) of the sheet tray 9D. "T5" is a storage size of the sheet of the sheet tray 9E in the width direction (X-axis direction) of the sheet tray 9E. Further, the width W10 of the opening 10 is wider than the width G1 of the image forming unit 7 in the width direction (X-axis direction). Thus, the image forming apparatus 1 includes the opening 10 below the image forming unit 7. The opening 10 defines a space having the width W10 wider than the width G1 of the image forming unit 7 at least in the width direction (X-axis direction).

As described above, in the image forming apparatus including the image forming unit 7 to form an image on a recording medium, the image forming apparatus 1 includes the opening 10 defining a space in the front face of the image forming apparatus 1. The opening 10 is disposed below the image forming unit 7. Further, the width W10 of the opening 10 is wider than the width G1 of the image forming unit 7 in the width direction (X-axis direction). Therefore, a user in a wheelchair can approach the image forming apparatus 1 and easily operate the image forming apparatus 1.

The opening 10 is formed as a part of the front face of the exterior housing 12 of the image forming apparatus 1. At least one end of the image forming unit 7 in the width direction (X-axis direction) forms a part of a side face of the exterior housing 12.

Further, the opening 10 and the image forming unit 7 are stacked in the height direction (Y-axis direction). Further, a part of the opening 10 and the image forming unit 7 overlap in the width direction (Y-axis direction). The storage 17 and a region of the opening 10 excluding a region of the opening 10 overlapping with the image forming unit 7 in the width direction (X-axis direction) are stacked in the height direction (Y-axis direction). The above-described term "stack" is not limited to "two members stacked with contacting each other" and may be "two members stacked with a third member interposed between two members", for example.

Thus, the opening 10 has a sufficient length in the width direction (X-axis direction). The opening 10 is disposed below the image forming unit 7 in the image forming apparatus 1. When a user in a wheelchair operates the image forming unit 7 and surrounding members of the image forming unit 7 in the image forming apparatus 1, a user in the wheelchair can extend the hand in the width direction (X-axis direction) and operates the image forming unit 7, each sheet trays 9, and each surrounding members of the image forming unit 7 while inserting the footrest of the wheelchair inside the opening 10.

Figure 11:
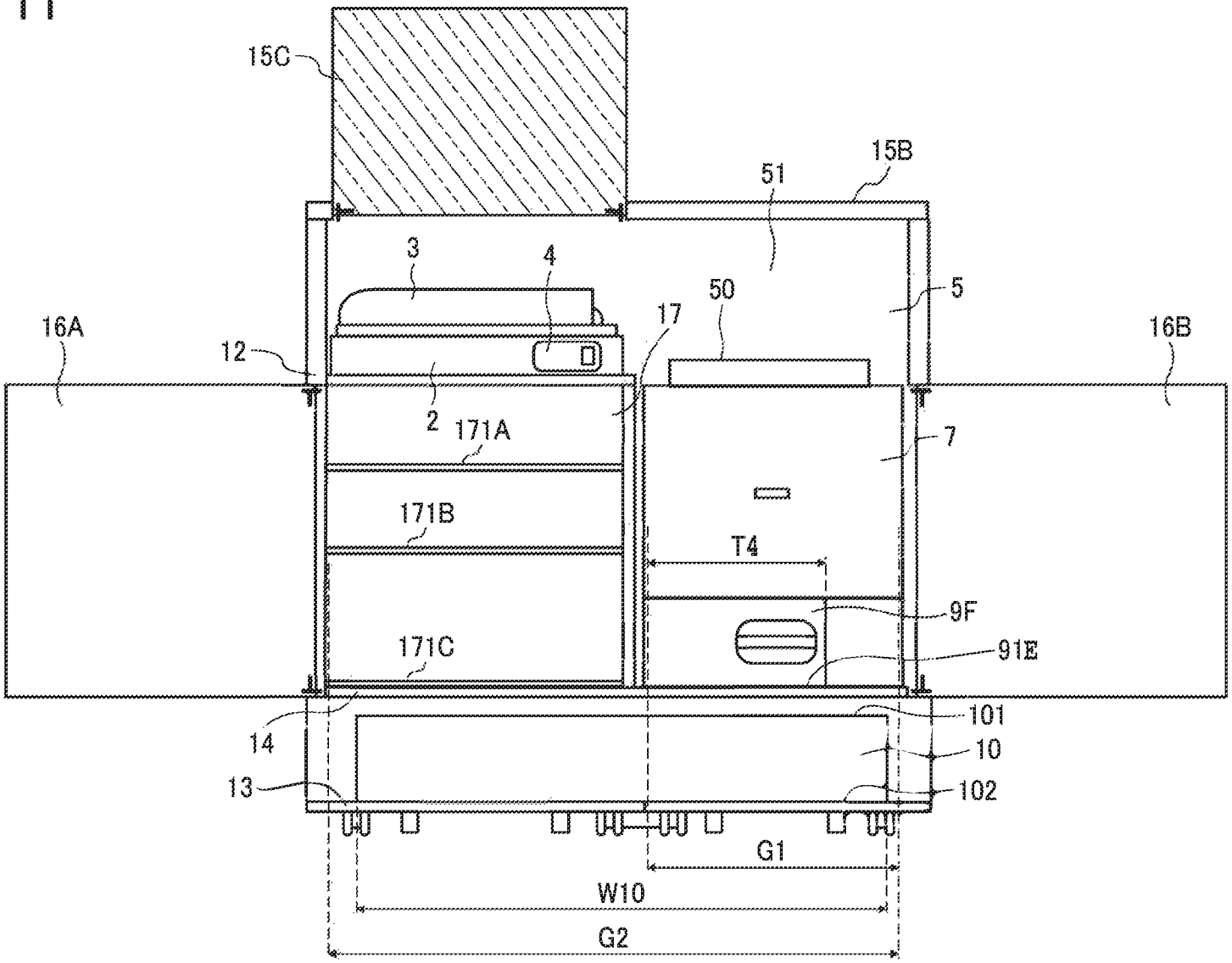
FIG. 11 is a front view of a second example of an internal configuration of the image forming apparatus according to the third embodiment.

FIG. 11 is a front view of a second example of an internal configuration of the image forming apparatus 1 according to the third embodiment. Unlike the example illustrated in FIG. 10, the image forming apparatus 1 includes one (single) sheet tray 9F under the image forming unit 7 on the right side of the image forming apparatus 1.

Figure 12:
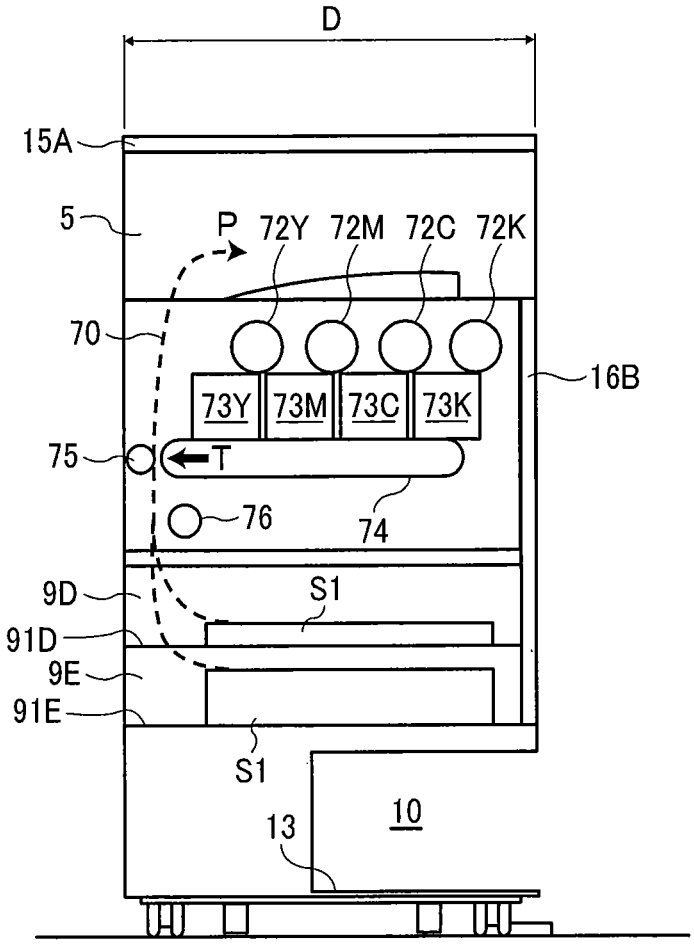
FIG. 12 is a cross-sectional view of an image forming apparatus according to a third embodiment.

FIG. 12 is a cross-sectional side view of the image forming apparatus according to a third embodiment of the present disclosure. FIG. 12 is a cross-sectional view along line A-A of the third embodiment illustrated in FIG. 10. A direction of conveyance of the sheet S1 is described with reference to FIG. 12. The image forming apparatus 1 according to the first embodiment as illustrated in FIG. 4 conveys a sheet S1 in the width direction (X-axis direction) of the image forming apparatus 1. Conversely, the image forming apparatus 1 according to the third embodiment as illustrated in FIG. 12 conveys a sheet from the sheet tray 9 to the back face of the image forming apparatus 1 in the depth direction (Z-axis direction). Thus, the direction of conveyance of the sheet is in the height direction (Y-axis direction) perpendicular to the width direction (X-axis direction) of the image forming apparatus 1. Thus, the direction of conveyance of the sheet can be appropriately selected in consideration of a layout of the image forming apparatus 1, user convenience, and the like.

Figure 13:
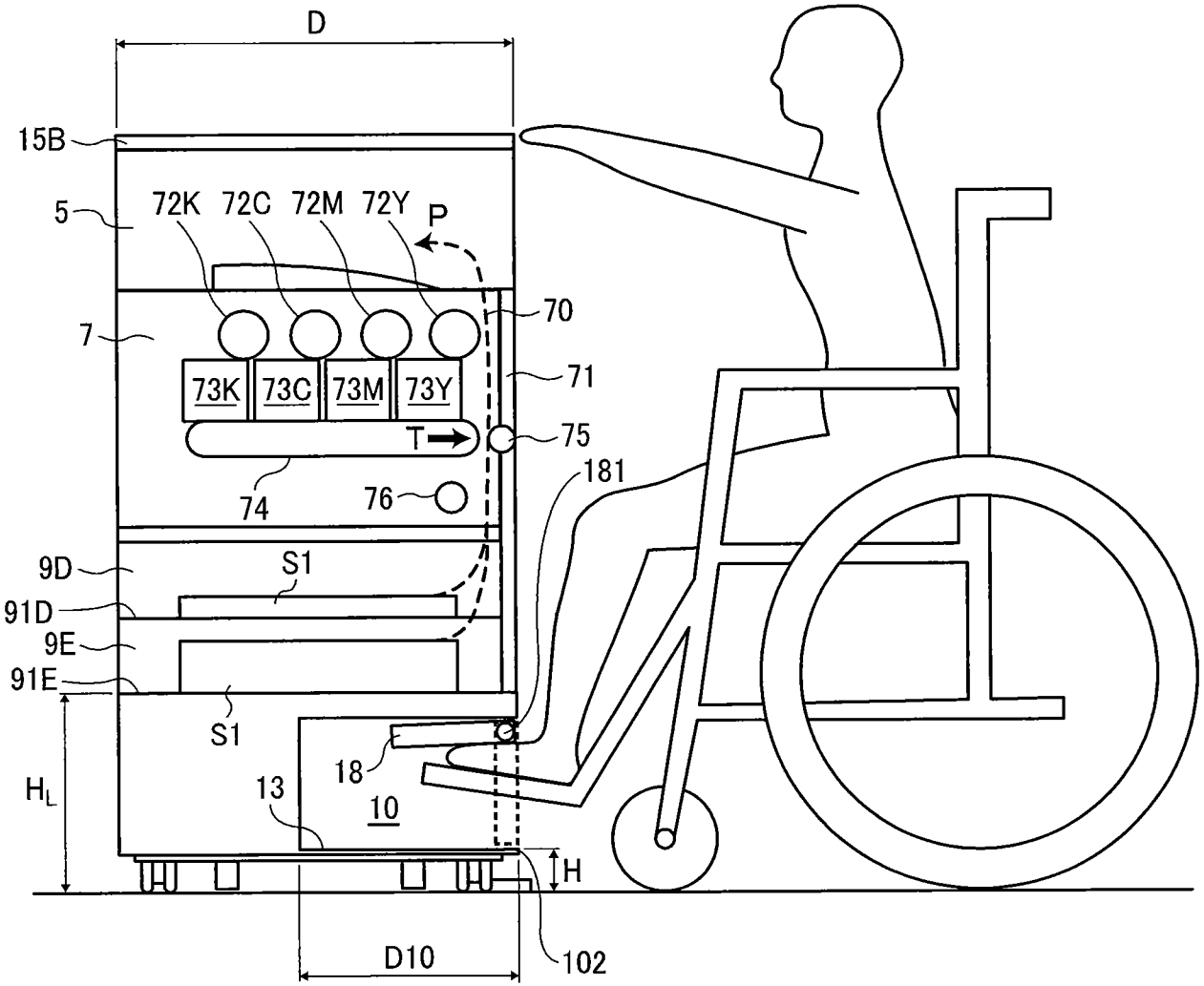
FIG. 13 is a cross-sectional view of an image forming apparatus according to the third embodiment.

FIG. 13 is a cross-sectional side view of a variation of the image forming apparatus 1 according to the third embodiment of the present disclosure. FIG. 13 illustrates the image forming apparatus 1 in which the front door 16D in FIG. 12 has been already opened.

The image forming apparatus 1 according to the third embodiment as illustrated in FIG. 12 conveys the sheet S1 from the sheet trays 9D and 9E to the back face of the image forming apparatus 1 in the depth direction (Z-axis direction). Conversely, the image forming apparatus 1 according to the third embodiment as illustrated in FIG. 13 conveys the sheet S1 from the sheet trays 9D and 9E to the front face of the image forming apparatus 1 in the depth direction (Z-axis direction).

That is, the conveyance path 70 is disposed in the front face of the exterior housing 12, and the conveyance path 70 guides the sheet S1 from the sheet trays 9D and 9E to the ejection unit 5 via the image forming unit 7.

Further, the secondary transfer roller 75 is provided on the openably closable member 71 (openably closable cover, for example) of the image forming unit 7. Opening and closing the openably closable member 71 moves the secondary transfer roller 75 between a secondary transfer position at which an image is secondary transferred to the sheet S1 and an opening position at which the conveyance path 70 is opened. The openably closable member 71 is openably closable and is provided on the front face of the exterior housing 12.

Thus, opening the openably closable member 71 and the conveyance path 70 of the image forming apparatus 1 from the front face of the image forming apparatus 1 as described above enables a jam processing in the conveyance path 70 from the front face of the image forming apparatus 1 (front access type).

The conveyance path 70 as illustrated in FIG. 2 includes the jam processing unit 8 in the second region (space) so that it is difficult to provide storage 17, etc., in the image forming apparatus 1. Conversely, a user can access to the image forming apparatus 1 according to the third embodiment as illustrated in FIG. 13 from the front face of the image forming apparatus 1 (front access type). Thus, the image forming apparatus 1 according to the third embodiment as illustrated in FIG. 13 does not have to include the jam processing unit 8 in the second region (space), and the storage 17 can be provided in the image forming apparatus 1.

Thus, the direction of conveyance of the sheet S1 is in the depth direction (Z-axis direction) perpendicular to the width direction (X-axis direction) of the image forming apparatus 1. Thus, the direction of conveyance of the sheet S1 can be appropriately selected in consideration of a layout of the image forming apparatus 1, convenience of the user, and the like.

The variation of the present disclosure in FIG. 13 further includes the opening cover 18 to cover the opening 10 in addition of the configuration as illustrated in FIGS. 9 to 12.

The opening cover 18 is a rectangle plate conforming to a shape of the opening 10, for example. The opening cover 18 can prevent dust or the like from entering inside the image forming apparatus 1. Further, the opening cover 18 can improve appearance of the image forming apparatus 1 and increase an effect of soundproof of sound emitted by the image forming unit 7 at time of image formation, for example.

The opening cover 18 covers the opening 10 with one side (upper side in FIG. 12) of the rectangle supported by a shaft 181. The shaft 181 rotatably supports the opening cover 18 so that the opening cover 18 rotates around the shaft 181. The shaft 181 is fixed to the exterior housing 12 as an example.

When the footrest of the wheelchair pushes the opening cover 18 from outside the image forming apparatus 1, the opening cover 18 is pushed into the image forming apparatus 1 while the opening cover 18 rotates around the shaft 181 as a rotation axis.

When the footrest of the wheelchair comes out of the opening 10, the opening cover 18 returns to an original position, that is, a position covering the opening 10 by own weight of the opening cover 18. A broken line in FIG. 13 illustrates a state in which the opening cover 18 covers the opening 10 in FIG. 10, and a solid line in FIG. 13 illustrates a state in which the opening cover 18 is pushed into the image forming apparatus 1.

Thus, the opening cover 18 opens the opening 10 when the image forming apparatus 1 is used by the user and covers and shields the opening 10 when the image forming apparatus 1 is not in use. When the user in a wheelchair uses the image forming apparatus 1, the footrest of the wheelchair pushes the opening cover 18 so that the opening cover 18 is pushed into the image forming apparatus 1 while the opening cover 18 rotates around the shaft 181 as the rotation axis. Thus, the user can operate the image forming apparatus 1 while the footrest of the wheelchair is inserted inside the opening 10 without being blocked by the opening cover 18.

Figure 14:
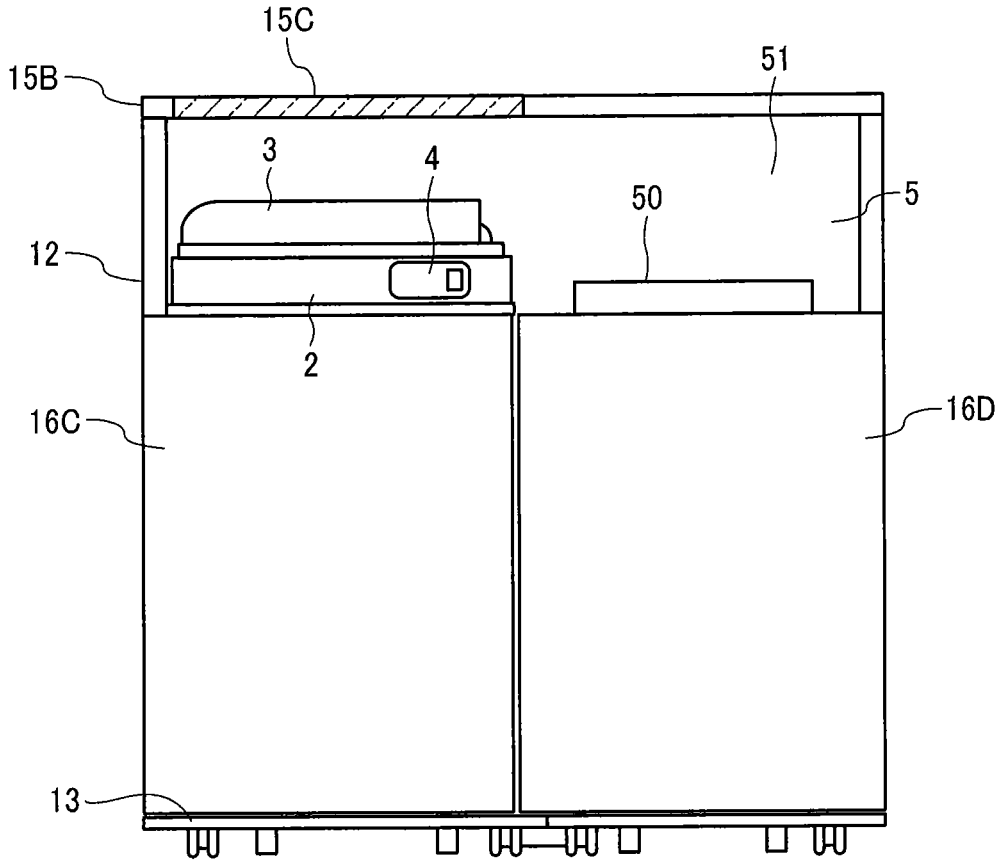
FIG. 14 is a front view of a variation of the image forming apparatus according to the third embodiment.

FIG. 14 is a front view of the image forming apparatus 1 according to a third embodiment. In the image forming apparatus 1 according to the third embodiment, a structure of a front door is different from a structure of the front door in FIG. 9. That is, the left front door 16A and the right front door 16B in FIG. 9 do not cover the opening 10. Conversely, the left front door 16C and the right front door 16D in the third embodiment cover the opening 10, respectively.

Thus, a configuration of the front doors 16C and 16D can be appropriately determined in consideration of a layout of the image forming apparatus 1, user convenience, and the like. For example, each of the right front door 16D and the left front door 16C may be divided into a plurality of doors in the height direction (Y-axis direction). The image forming apparatus 1 including storages 17 in an inner space as illustrated in FIG. 10 may further include doors corresponding to the respective storages 17.

In the above-described embodiments, a width, a height, and a depth, etc. of the opening 10 of the image forming apparatus 1 are described in consideration of user convenience of a wheelchair. However, the opening 10 may be used as a storage to store desired items by a user. Thus, a user can appropriately select a size, for example, suitable for the storage 17. Further, a cover may be provided for closing the opening 10 when the opening 10 is not in use. Further, a partition or a shelf may be provided inside the opening 10, for example.

An internal space of the image forming apparatus 1 is described below. As described above, the image forming apparatus 1 includes an internal space used for a predetermined purpose in the image forming apparatus 1. Examples of the internal space include the loading unit 6, the opening 10, the storage 17, and the jam processing unit 8. The opening 10 includes a space to accommodate the footrest of the wheelchair. The storage 17 includes a space (enclosure) to accommodate articles and the like inside the storage 17. The jam processing unit 8 includes the jam processing space 85 as a space (enclosure) to takeout (remove) the sheet S1 for jam processing.

However, examples of the internal space are not limited to the embodiments as described above. For example, the sheet trays 9A, 9B, and 9C are examples of the internal space including a space to store the sheets S1 in the space. When the internal space is formed below the image forming unit 7 together with the image forming unit 7 as a single body, the internal space may be considered as a part of the image forming unit 7. The internal space is defined by a ceiling and side walls as a part of the exterior housing 12, for example.

When each of the internal spaces is positioned above the image forming unit 7, the internal space may be referred to as an "upper space". When each of the internal spaces is arranged side by side with the image forming unit 7 in the lateral (width) direction (X-axis direction), the internal space may be referred to as a "side-by-side space". When each of the internal spaces is positioned below the image forming unit 7, the internal space may be referred to as a "lower space".

A variation of the internal configuration of the image forming apparatus 1 is described with reference to FIGS. 15 to 20.

Figure 15:
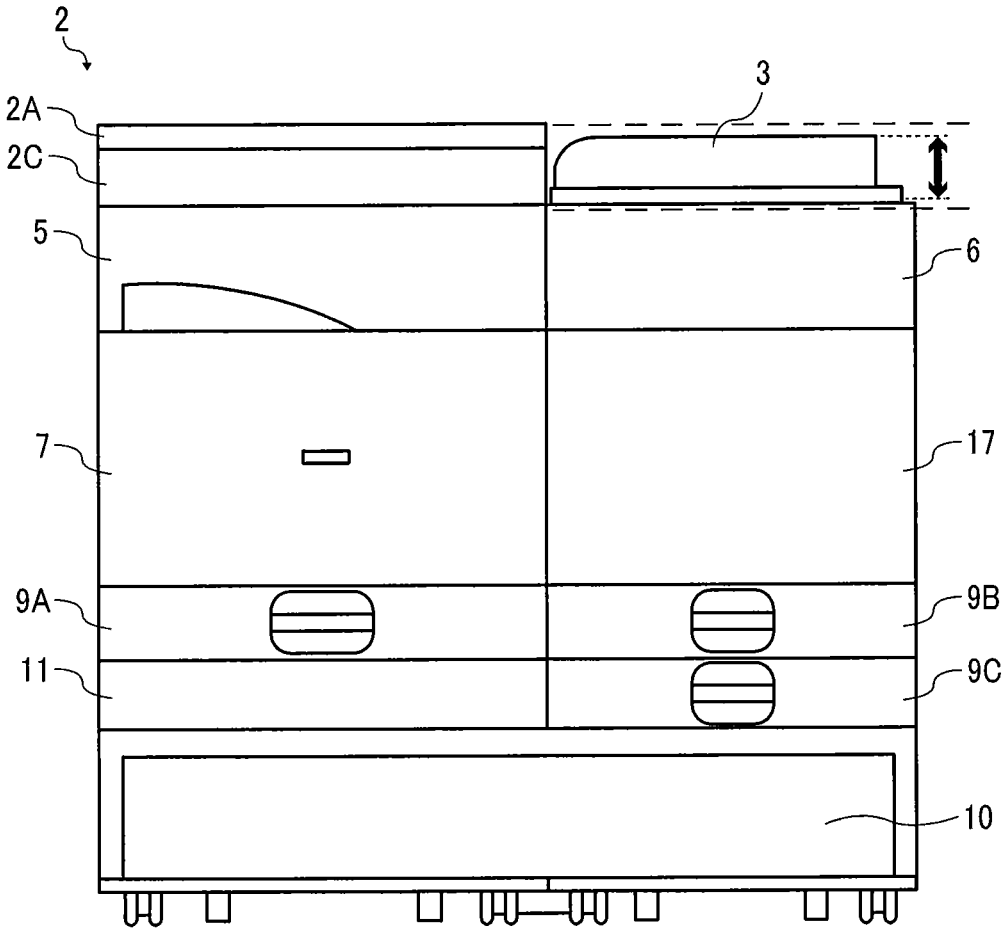
FIG. 15 is a front view of an example of a first arrangement of the internal configuration of the image forming apparatus.

FIG. 15 is a front view of an example of a first arrangement of the internal configuration of the image forming apparatus 1. The scanner 2 and the automatic document feeder 3 overlap in the height direction, and are arranged side by side in the lateral (width) direction (X-axis direction). A broken line in FIG. 15 indicates a height of the scanner 2. A dotted line in FIG. 15 indicates a height of the automatic document feeder 3. There is an overlapping portion indicated by black arrow between the broken line of the height of the scanner 2 and the dotted line of the height of the automatic document feeder 3. Thus, the scanner 2 and the automatic document feeder 3 overlap in the height direction (Y-axis direction).

The storage 17 is a space (enclosure) arranged side by side with the image forming unit 7. The storage 17 is provided on a right side of the image forming unit 7. A loading unit 6 is an example of a space (enclosure) disposed above the storage 17. Further, the sheet trays 9B and 9C, and the opening 10 are spaces disposed below the storage 17. Further, the ejection unit 5 is a space (enclosure) disposed above the image forming unit 7. Further, the sheet trays 9A, the opening 10, and the electrical component housing 11 are spaces disposed below the image forming unit 7. The space arranged side by side with the image forming unit 7 is not limited to the storage 17 and may be the jam processing unit 8 or the like.

In FIG. 15, the scanner 2, the ejection unit 5, the image forming unit 7, the sheet tray 9A, and the electrical component housing 11 are stacked from the top on the left side (first region) in the width direction (X-axis direction) of the image forming apparatus 1. The automatic document feeder 3, the loading unit 6, the storage 17, the sheet trays 9B and 9C, and the opening 10 are disposed from the top on the right side (second region) in the width direction (X-axis direction) of the image forming apparatus 1. The above-described term "stack" is not limited to "two members stacked with contacting each other" and may be "two members stacked with a third member interposed between two members", for example.

Further, in FIG. 15, the scanner 2 and the ejection unit 5 are stacked in the height direction (Y-axis direction). The scanner 2 and the ejection unit 5 may be referred to as a "stacked portion". A height of the stacked portion including the scanner 2 and the ejection unit 5 is from an upper end of the scanner 2 to a lower end of the ejection unit 5. The automatic document feeder 3 is disposed side by side with the stacked portion in the height direction (Y-axis direction) so that the automatic document feeder 3 and the stacked portion overlap in the height direction (Y-axis direction). The scanner 2 and the ejection unit 5 are stacked so that both ends of the scanner 2 and the ejection unit 5 in the lateral (width) direction (X-axis direction) are at substantially the identical position.

The image forming apparatus 1 illustrated in FIG. 15 has a configuration in which the scanner 2 and the automatic document feeder 3 overlap in the height direction, and are arranged side by side in the lateral (width) direction (X-axis direction). Thus, compare to an image forming apparatus in which the entire elements (a scanner 2, an automatic document feeder 3, an ejection unit 5, a loading unit 6, an image forming unit 7, a sheet tray 9, an electrical component housing 11, and a storage 17 are stacked in the height direction (Y-axis direction) and the automatic document feeder 3 is disposed at the top of the elements, the image forming apparatus 1 according to the present disclosure can lower a position of the automatic document feeder 3 in the height direction (Y-axis direction).

Thus, the image forming apparatus 1 can reduce an operation range of a user to operate the automatic document feeder 3 in the height direction (Y-axis direction). Further, the pressure plate 2A is an upper portion of the scanner 2. Thus, a user can operate the scanner 2 lightly without open and close the automatic document feeder 3 to read the document by the automatic document feeder 3 which is a member larger than the pressure plate 2A. Further, a reading accuracy of the automatic document feeder (ADF) can be improved by not opening and closing the automatic document feeder 3.

Figure 16:
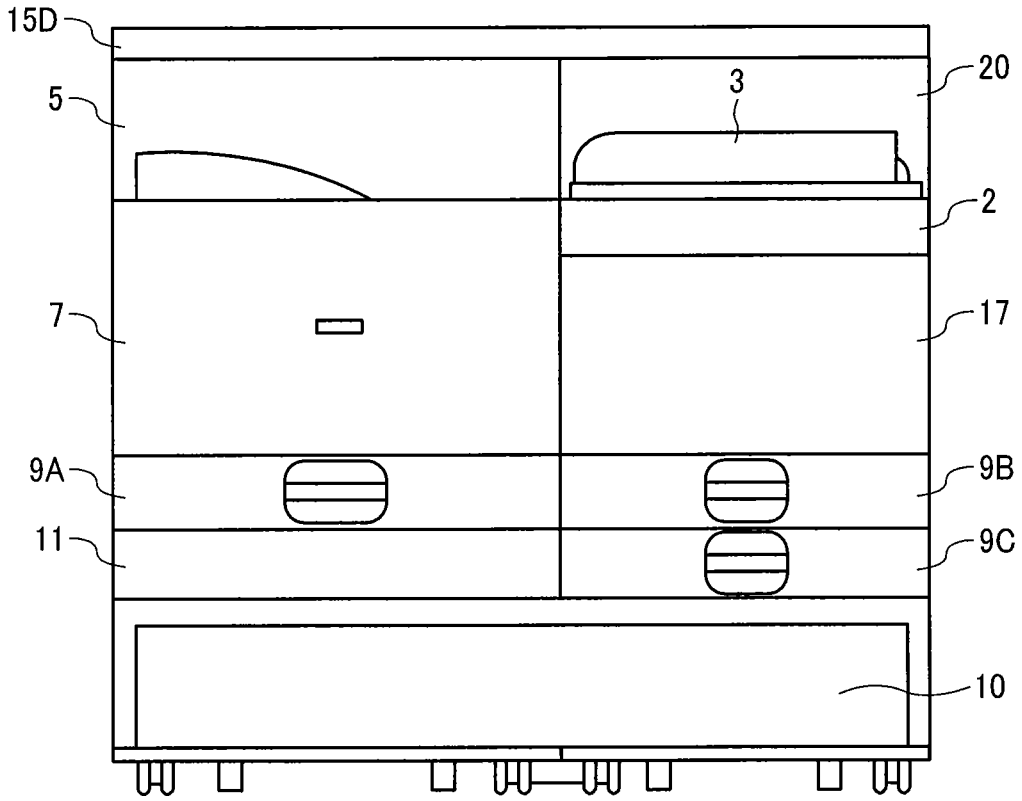
FIG. 16 is a front view of an example of a second arrangement of the internal configuration of the image forming apparatus.

FIG. 16 is a front view of an example of a second arrangement of the internal configuration of the image forming apparatus 1. In FIG. 16, the ejection unit 5 and the automatic document feeder 3 overlap in the height direction (Y-axis direction), and are arranged side by side in the lateral (width) direction (X-axis direction).

The storage 17 is a space (enclosure) arranged side by side with the image forming unit 7. The storage 17 is provided on a right side of the image forming unit 7. The scanner 2 is disposed side by side with the image forming unit 7.

Further, the image forming apparatus 1 includes an operation space 20 above the automatic document feeder 3 as an example of an internal space. A user can operate the automatic document feeder 3 and other members of the image forming apparatus 1 using the operation space 20. The operation space 20 is an example of a space (enclosure) above the storage 17. The operation space 20 may be disposed above the image forming unit 7 as an example of a space.

Further, the sheet tray 9A, 9B, and 9C, the opening 10, and the electrical component housing 11 are spaces disposed below the image forming unit 7. The sheet trays 9B and 9C, and the opening 10, are spaces disposed below the storage 17.

The relative positions between the scanner 2, the automatic document feeder 3, the ejection unit 5, the image forming unit 7, the sheet trays 9A to 9C, the electrical component housing 11, and the storage 17 may be appropriately changed in consideration of a layout of the image forming apparatus 1, user convenience, and the like. The space arranged side by side with the image forming unit 7 is not limited to the storage 17 and may be the jam processing unit 8 or the like.

In FIG. 16, the top plate 15D, the ejection unit 5, the image forming unit 7, the sheet tray 9A, the electrical component housing 11, and the opening 10 are stacked from the top on the left side (first region) in the width direction (X-axis direction) of the image forming apparatus 1. The top plate 15D, the operation space 20, the automatic document feeder 3, the scanner 2, the storage 17, the sheet trays 9B and 9C, and the opening 10 are stacked from the top on the right side (second region) in the width direction (X-axis direction) of the image forming apparatus 1. The above-described term "stack" is not limited to "two members stacked with contacting each other" and may be "two members stacked with a third member interposed between two members", for example.

Further, in FIG. 16, the scanner 2 and the automatic document feeder 3 are stacked in the height direction (Y-axis direction), and the scanner 2 and the automatic document feeder 3 may be called a "stacked portion". A height of the stacked portion including the scanner 2 and the automatic document feeder 3 is from a lower end of the scanner 2 to an upper end of the automatic document feeder 3.

The ejection unit 5 is disposed side by side with the stacked portion in the height direction (Y-axis direction) so that the ejection unit 5 and the stacked portion overlap in the height direction (Y-axis direction). The scanner 2 and the automatic document feeder 3 are stacked so that both ends of the scanner 2 and the ejection unit 5 in the lateral (width) direction (X-axis direction) are at substantially the identical position.

Thus, the image forming apparatus 1 as illustrated in FIG. 16 can lower the positions of the scanner 2 and the automatic document feeder 3 in the height direction (Y-axis direction). Thus, the image forming apparatus 1 can reduce an operation range of a user to operate the scanner 2 and the automatic document feeder 3 in the height direction (Y-axis direction). Further, providing the top plate 15D above the ejection unit 5 enables a user to work on the top plate 15D using a sheet, on which an image is formed, ejected from the ejection unit 5. Further, the automatic document feeder 3 is surrounded by the exterior housing 12 and the top plate 15D, and quietness is thus improved.

Figure 17:
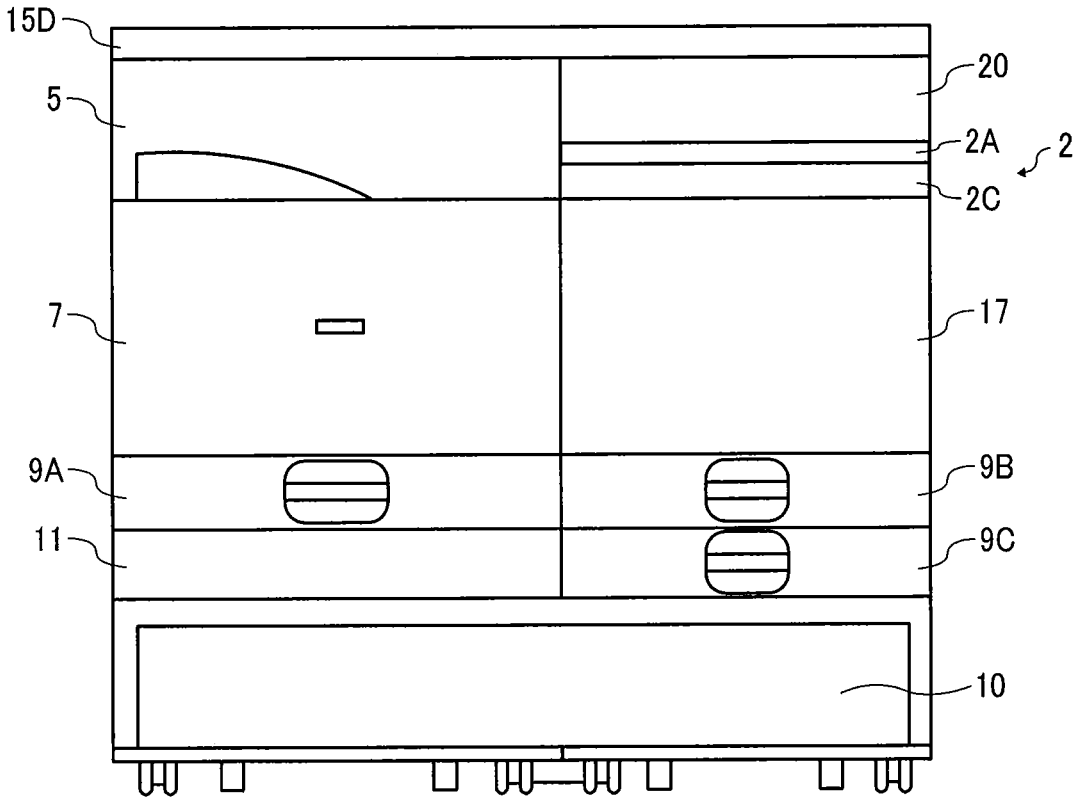
FIG. 17 is a front view of an example of a third arrangement of the internal configuration of the image forming apparatus.

FIG. 17 is a front view of an example of a third arrangement of the internal configuration of the image forming apparatus 1. In FIG. 17, the ejection unit 5 and the scanner 2 overlap in the height direction (Y-axis direction), and are arranged side by side in the lateral (width) direction (X-axis direction).

The storage 17 is a space (enclosure) arranged side by side with the image forming unit 7. The storage 17 is provided on a right side of the image forming unit 7. The operation space 20 is an example of a space (enclosure) above the image forming unit 7. Further, the sheet tray 9A, 9B, and 9C, the opening 10, and the electrical component housing 11 are spaces disposed below the image forming unit 7. The space arranged side by side with the image forming unit 7 is not limited to the storage 17 and may be the jam processing unit 8 or the like.

In FIG. 17, the top plate 15D, the ejection unit 5, the image forming unit 7, the sheet tray 9A, the electrical component housing 11, and the opening 10 are stacked from the top on the left side (first region) in the width direction (X-axis direction) of the image forming apparatus 1. The top plate 15D, the operation space 20, the scanner 2, the storage 17, the sheet trays 9B and 9C, and the opening 10 are stacked from the top on the right side (second region) in the width direction (X-axis direction) of the image forming apparatus 1. The above-described term "stack" is not limited to "two members stacked with contacting each other" and may be "two members stacked with a third member interposed between two members", for example.

Thus, the image forming apparatus 1 as illustrated in FIG. 17 can lower the positions of the scanner 2 in the height direction (Y-axis direction). Thus, the image forming apparatus 1 can reduce an operation range of a user to operate the scanner 2 in the height direction (Y-axis direction). Further, providing the top plate 15D above the ejection unit 5 enables a user to work on the top plate 15D using a sheet, on which an image is formed, ejected from the ejection unit 5.

Figure 18:
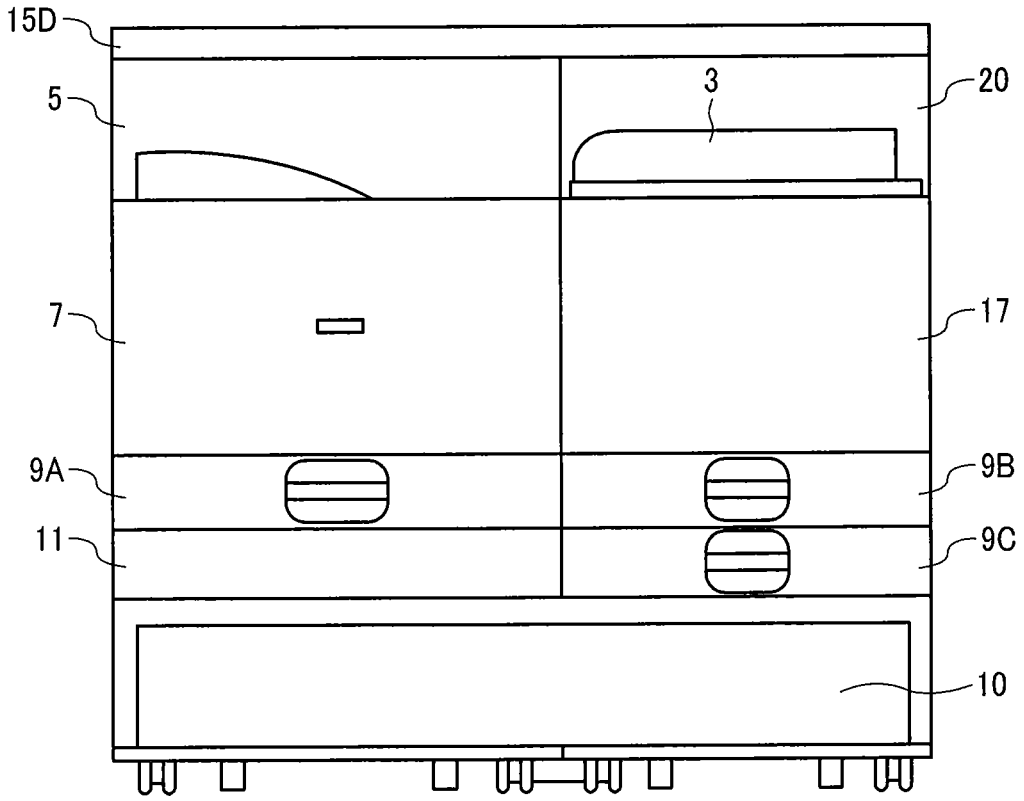
FIG. 18 is a front view of an example of a fourth arrangement of the internal configuration of the image forming apparatus.

FIG. 18 is a front view of an example of a fourth arrangement of the internal configuration of the image forming apparatus 1. In FIG. 16, the ejection unit 5 and the automatic document feeder 3 overlap in the height direction (Y-axis direction), and are arranged side by side in the lateral (width) direction (X-axis direction).

The storage 17 is a space (enclosure) arranged side by side with the image forming unit 7. The storage 17 is provided on a right side of the image forming unit 7. The operation space 20 is an example of a space (enclosure) above the storage 17. Further, the sheet tray 9A, the opening 10, and the electrical component housing 11 are spaces disposed below the image forming unit 7. The space arranged side by side with the image forming unit 7 is not limited to the storage 17 and may be the jam processing unit 8 or the like.

In FIG. 18, the top plate 15D, the ejection unit 5, the image forming unit 7, the sheet tray 9A, the electrical component housing 11, and the opening 10 are stacked from the top on the left side (first region) in the width direction (X-axis direction) of the image forming apparatus 1. The top plate 15D, the operation space 20, the automatic document feeder 3, the storage 17, the sheet trays 9B and 9C, and the opening 10 are stacked from the top on the right side (second region) in the width direction (X-axis direction) of the image forming apparatus 1. The above-described term "stack" is not limited to "two members stacked with contacting each other" and may be "two members stacked with a third member interposed between two members", for example.

Thus, the image forming apparatus 1 as illustrated in FIG. 18 can lower the positions of the automatic document feeder 3 in the height direction (Y-axis direction). Thus, the image forming apparatus 1 can reduce an operation range of a user to operate the automatic document feeder 3 in the height direction (Y-axis direction). Further, providing the top plate 15D above the ejection unit 5 enables a user to work on the top plate 15D using a sheet, on which an image is formed, ejected from the ejection unit 5. There is no scanner 2 below the automatic document feeder 3. Thus, a structure such as a hinge for opening and closing the automatic document feeder 3 for the scanner 2 becomes unnecessary. Further, the storage 17 is provided below the automatic document feeder 3. Thus, the documents, the images of which have been read by the automatic document feeder 3, can be stacked in the storage 17.

Figure 19:
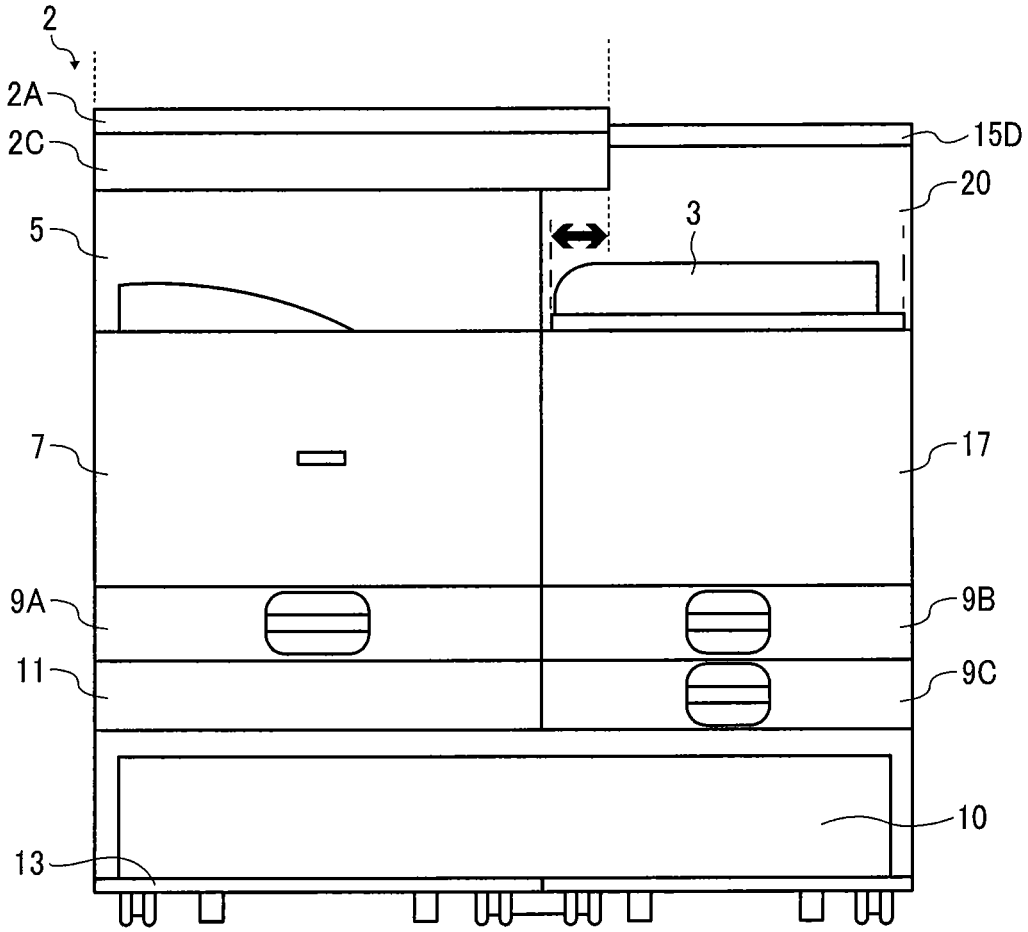
FIG. 19 is a front view of an example of a fifth arrangement of the internal configuration of the image forming apparatus.

FIG. 19 is a front view of an example of a fifth arrangement of the internal configuration of the image forming apparatus 1. In FIG. 16, the ejection unit 5 and the automatic document feeder 3 overlap in the height direction (Y-axis direction), and are arranged side by side in the lateral (width) direction (X-axis direction).

The storage 17 is a space (enclosure) arranged side by side with the image forming unit 7. The storage 17 is disposed on a right side of the image forming unit 7. The operation space 20 is an example of a space (enclosure) above the storage 17. The ejection unit 5 is an example of a space (enclosure) above the image forming unit 7. The operation space 20 may be disposed above the image forming unit 7 as an example of a space (enclosure).

Further, the sheet tray 9A, the opening 10, and the electrical component housing 11 are spaces disposed below the image forming unit 7. The sheet trays 9B and 9C, and the opening 10, are spaces disposed below the storage 17.

The relative positions between the scanner 2, the automatic document feeder 3, the ejection unit 5, the image forming unit 7, the sheet trays 9A to 9C, the electrical component housing 11, and the storage 17 may be appropriately changed in consideration of a layout of the image forming apparatus 1, user convenience, and the like.

The space arranged side by side with the image forming unit 7 is not limited to the storage 17 and may be the jam processing unit 8 or the like.

In FIG. 19, the scanner 2, the ejection unit 5, the image forming unit 7, the sheet tray 9A, the electrical component housing 11, and the opening 10 are stacked from the top on the left side in the width direction (X-axis direction) of the image forming apparatus 1. The top plate 15D, the operation space 20, the automatic document feeder 3, the storage 17, the sheet trays 9B and 9C, and the opening 10 are stacked from the top on the right side in the width direction (X-axis direction) of the image forming apparatus 1. The above-described term "stack" is not limited to "two members stacked with contacting each other" and may be "two members stacked with a third member interposed between two members", for example.

Further, in the variation of the image forming apparatus 1 in FIG. 19, the scanner 2 and the automatic document feeder 3 overlap in the width direction (X-axis direction) as indicated by arrow in FIG. 19. A dotted line in FIG. 19 indicates a width of the scanner 2. A broken line in FIG. 19 indicates a width of the automatic document feeder 3. There is an overlapping portion indicated by arrow between the dotted line of the width of the scanner 2 and the broken line of the width of the automatic document feeder 3. Thus, the scanner 2 and the automatic document feeder 3 overlap in the width direction (X-axis direction) of the image forming apparatus 1.

Further, in FIG. 19, the scanner 2 and the ejection unit 5 are stacked in the height direction (Y-axis direction). The scanner 2 and the ejection unit 5 may be referred to as a "stacked portion". A height of the stacked portion including the scanner 2 and the ejection unit 5 is from an upper end of the scanner 2 to a lower end of the ejection unit 5.

The automatic document feeder 3 is disposed side by side with the stacked portion in the height direction (Y-axis direction) so that the automatic document feeder 3 and the stacked portion overlap in the height direction (Y-axis direction). The scanner 2 and the ejection unit 5 are stacked so that both ends of the scanner 2 and the ejection unit 5 are not at substantially the identical position. Thus, the scanner 2 and the ejection unit 5 are stacked so that a position at right end of the scanner 2 and a position at right end of the ejection unit 5 are at different positions (shifted positions) in the width direction (X-axis direction).

Thus, the image forming apparatus 1 as illustrated in FIG. 19 can lower the positions of the automatic document feeder 3 in the height direction (Y-axis direction). Thus, the image forming apparatus 1 can reduce an operation range of a user to operate the automatic document feeder 3 in the height direction (Y-axis direction). Further, providing the top plate 15D above the ejection unit 5 enables a user to work on the top plate 15D using a sheet, on which an image is formed, ejected from the ejection unit 5. There is no scanner 2 below the automatic document feeder 3.

Thus, a structure such as a hinge for opening and closing the automatic document feeder 3 for the scanner 2 becomes unnecessary. Further, to read an image on a document having a large size, the scanner 2 having a relatively large width in the width direction (X-axis direction) of the image forming apparatus 1 may preferably be mounted on the image forming apparatus 1. Further, in the variation of the image forming apparatus 1 in FIG. 19, the scanner 2 and the automatic document feeder 3 are disposed at different heights in the height direction (Y-axis direction).

A portion of the scanner 2 and a portion of the automatic document feeder 3 overlap in the width direction (X-axis direction). Thus, a combined width of the scanner 2 and the automatic document feeder 3 is within (equal to or smaller than) the width "W" of the image forming apparatus 1.

Figure 20:
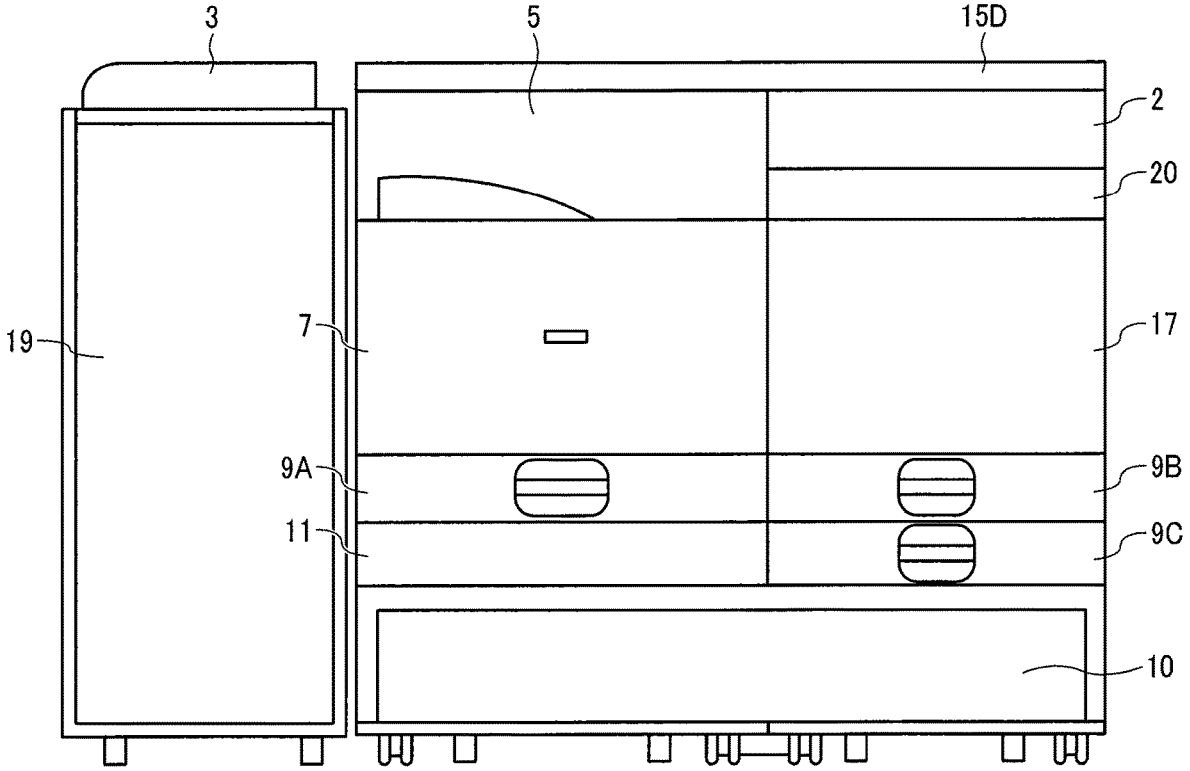
FIG. 20 is a front view of an example of a sixth arrangement of the internal configuration of the image forming apparatus.

FIG. 20 is a front view of an example of a sixth arrangement of the internal configuration of the image forming apparatus 1. The scanner 2, the automatic document feeder 3, and the ejection unit 5 overlap in the height direction (Y-axis direction), and are arranged side by side in the lateral (width) direction (X-axis direction).

The storage 17 is a space (enclosure) arranged side by side with the image forming unit 7. Further, the image forming apparatus 1 includes a storage 19 disposed side by side with the storage 17 with the image forming unit 7 in between. Thus, the storage 19 is disposed opposite the storage 17 with the image forming unit 7 interposed between the storage 19 and the storage 17. The storage 17 is provided on the right side of the image forming unit 7, and the storage 19 is provided on the left side of the image forming unit 7.

The operation space 20 is an example of a space (enclosure) above the storage 17. Further, a part of the storage 19 is also an example of a space (enclosure) above the image forming unit 7. Further, the sheet tray 9A, the opening 10, and the electrical component housing 11 are spaces disposed below the image forming unit 7. Further, a part of the storage 19 is also an example of a space (enclosure) below the image forming unit 7. A space (enclosure) arranged side by side with the image forming unit 7 is not limited to the storage 17, and may be the jam processing unit 8 or the like.

In FIG. 20, the automatic document feeder 3 and the storage 19 are stacked from the top on the leftist side in the width direction (X-axis direction) of the image forming apparatus 1. In FIG. 20, the top plate 15D, the ejection unit 5, the image forming unit 7, the sheet tray 9A, the electrical component housing 11, and the opening 10 are stacked from the top on a middle side (right side of the leftist side) in the width direction (X-axis direction) of the image forming apparatus 1.

The middle side (right side of the leftist side) may be considered as the first region. The top plate 15D, the scanner 2, the storage 17, the operation space 20, the storage 17, the sheet trays 9B and 9C, and the opening 10 are stacked from the top on the rightest side (second region) in the width direction (X-axis direction) of the image forming apparatus 1. The above-described term "stack" is not limited to "two members stacked with contacting each other" and may be "two members stacked with a third member interposed between two members", for example.

Thus, the image forming apparatus 1 as illustrated in FIG. 20 can lower the position of the automatic document feeder 3 in the height direction (Y-axis direction). Thus, the image forming apparatus 1 can reduce an operation range of a user to operate the automatic document feeder 3 in the height direction (Y-axis direction). Further, the top plate 15D is provided above the ejection unit 5. Further, providing the top plate 15D above the ejection unit 5 enables a user to work on the top plate 15D using a sheet, on which an image is formed, ejected from the ejection unit 5. There is no scanner 2 below the automatic document feeder 3. Thus, a structure such as a hinge for opening and closing the automatic document feeder 3 for the scanner 2 becomes unnecessary.

Each of the variations illustrated in FIGS. 14 to 19 includes at least two of the scanner 2, the automatic document feeder 3, and the ejection unit 5 are disposed side by side. Thus, the present disclosure can lower the height of the image forming apparatus 1 compared to the configuration in which three elements of the scanner 2, the automatic document feeder 3, and the ejection unit 5 are stacked in the height direction (Y-axis direction).

Thus, a space (enclosure) arranged side by side with the image forming unit 7 is formed. The space can be effectively used as the jam processing unit 8, the storage 17, or the like. For example, a space (enclosure) common with a duct may be provided to process the jam. However, the image forming apparatus 1 according to the present disclosure has a sufficient space to process the jam compared to an image forming apparatus using the space common with the duct to process the jam. Also, the space can be used as the storage 17 to store an object.

With the above-described configuration, a degree of design freedom in the arrangement of the rear, left-side, and right-side faces of the image forming apparatus 1 is expanded. The above-described scanner 2 and automatic document feeder 3 has an openably closable configuration. Thus, the scanner 2 and the automatic document feeder 3 do not exceed the back face of the image forming apparatus 1 in accordance with opening and closing operation of a user. Therefore, the rear face of the image forming apparatus 1 can be brought into close contact with a wall of a room, an office, or the like.

Further, as described above, the ejection unit 5, each sheet trays 9, the jam processing unit 8, and the like are arranged within the width of the image forming apparatus 1 and are operable within the width of the image forming apparatus 1. Thus, an office furniture such as a cabinet can be substantially in close contact with the left face and the right face of the image forming apparatus 1. Thus, restrictions on installing the image forming apparatus 1 in the office are reduced, and the image forming apparatus 1 can be coexisted with other office furniture.

An image forming apparatus may include a sheet tray, an ejection unit, and a scanner stacked in the height direction (Y-axis direction), and an openably closable automatic document feeder is further stacked on an upper portion of the scanner. Then, a height to operate a lowest sheet tray of the image forming apparatus is about 100 mm from a floor. Thus, a height of an automatic document feeder when the automatic document feeder is opened becomes about 1200 mm from the floor, and the height of the automatic document feeder becomes not appropriate for a user to use the image forming apparatus. An operation height thus becomes from about 100 mm to 1200 mm, the operation height not easily used by a user.

Conversely, in each of the above-described embodiments, the sheet trays 9 are arranged side by side in the lateral (width) direction (X-axis direction) to reduce the height of the sheet tray 9. Further, the scanner 2 is disposed to be shifted from the ejection unit 5 in the lateral (width) direction (X-axis direction). Thus, the image forming apparatus 1 according to the present disclosure can reduce a range of a height to operate each elements of the image forming apparatus 1. Thus, the image forming apparatus 1 has a height that enables many user to easily use the image forming apparatus 1.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. An image forming apparatus comprising:

an exterior housing having an enclosed space therein to accommodate at least one of a scanner configured to read the image on a document, a document feeder configured to read an image on a document while conveying the document, a loading unit configured to load the document or a sheet, and a storage including a shelf;

an image forming unit in the exterior housing side by side with the enclosed space in a lateral direction, the image forming unit configured to form an image on the sheet;

a sheet tray below the image forming unit, the sheet tray configured to be drawable from a front face of the exterior housing;

an ejection unit above the image forming unit, the ejection unit configured to eject the sheet on which the image is formed by the image forming unit;

a plurality of rollers configured to guide a sheet along a conveyance path on the front face of the exterior housing from the sheet tray to the ejection unit via the image forming unit; and an openably closable cover in the front face of the exterior housing, the openable closable cover configured to selectively provide access to the conveyance path.

2. The image forming apparatus according to claim 1, further comprising:

a support below the enclosed space, the support configured to support the image forming unit, wherein a width of the support is wider than a width of the image forming unit in the lateral direction.

3. The image forming apparatus according to claim 2, wherein the enclosed space is an upper space and the exterior housing has an opening therein below the support, the opening defining a lower space.

4. The image forming apparatus according to claim 1, further comprising:

the scanner in the enclosed space, to read the image on a document, the scanner including, a reading unit on which the document to be read is placed, and a pressure plate to press the document, the pressure plate being openably closable to the reading unit.

5. The image forming apparatus according to claim 4, wherein the scanner further includes a pressure plate shaft on an end of the image forming apparatus in the lateral direction with an axial direction of the pressure plate shaft along a depth direction of the image forming apparatus orthogonal to the lateral direction, the pressure plate shaft configured to rotatably support the pressure plate.

6. The image forming apparatus according to claim 4, wherein the scanner further includes a pressure plate shaft on a central portion of the image forming apparatus in the lateral direction with an axial direction of the pressure plate shaft along a depth direction of the image forming apparatus orthogonal to the lateral direction, the pressure plate shaft configured to rotatably support the pressure plate.

7. The image forming apparatus according to claim 4, wherein the pressure plate is slidably movable with respect to the reading unit in the lateral direction of the image forming apparatus.

8. The image forming apparatus according to claim 7, wherein the pressure plate is slidably movable between a first position above the ejection unit and a second position above the enclosed space.

9. The image forming apparatus according to claim 1, wherein the document feeder is in the enclosed space, and the document feeder is openably closable to the loading unit.

10. An image forming apparatus according to claim 9, wherein the document feeder further includes a support shaft on an end of the image forming apparatus in the lateral direction with an axial direction of the support shaft along a depth direction of the image forming apparatus orthogonal to the lateral direction, the support shaft configured to rotatably support the document feeder.

11. The image forming apparatus according to claim 9, wherein the document feeder further includes a support shaft on a central portion of the image forming apparatus in the lateral direction with an axial direction of the support shaft is along a depth direction of the image forming apparatus orthogonal to the lateral direction, the support shaft configured to rotatably support the document feeder.

12. The image forming apparatus according to claim 9, the document feeder is configured to convey the document in a direction orthogonal to a direction of conveyance of the sheet on which the image is to be formed.

13. The image forming apparatus according to claim 1, wherein the plurality of rollers includes a secondary transfer roller on the openably closable cover such that, the openably closable cover is configured to selectively move the secondary transfer roller to an opening position at which the conveyance path accessible.

14. The image forming apparatus according to claim 1, further comprising:

a cover attached to the exterior housing, the cover configured to selectively cover the enclosed space.

15. The image forming apparatus according to claim 14, wherein the cover is supported by a shaft connecting an upper end of the cover to the exterior housing, the cover configured is configured to rotate about the shaft inwards into the housing in response to pressure applied thereto.

16. An image forming apparatus comprising:

an exterior housing having a space therein, the space configured to accommodate at least one of a scanner configured to read the image on a document, a document feeder configured to read an image on a document while conveying the document, a loading unit configured to load the document or the sheet, and a storage including a shelf;

an image forming unit in the exterior housing side by side with the space in a lateral direction, the image forming unit configured to form an image on a sheet;

a support below the space, the support configured to support the image forming unit, a width of the support being wider than a width of the image forming unit in the lateral direction;

a sheet tray below the image forming unit, the sheet tray configured to be drawable from a front face of the exterior housing;

an ejection unit above the image forming unit, the ejection unit configured to eject the sheet on which the image is formed by the image forming unit;

a plurality of rollers configured to guide a sheet along a conveyance path on the front face of the exterior housing from the sheet tray to the ejection unit via the image forming unit; and an openably closable cover in the front face of the exterior housing, the openable closable cover configured to selectively provide access to the conveyance path.

* * * * *